US006371592B1

(12) United States Patent
Otsuka et al.

(10) Patent No.: US 6,371,592 B1
(45) Date of Patent: Apr. 16, 2002

(54) PRINTING APPARATUS AND A PRINTING REGISTRATION METHOD

(75) Inventors: Naoji Otsuka, Yokohama; Kiichiro Takahashi, Kawasaki; Hitoshi Nishikori, Inagi; Osamu Iwasaki, Tokyo; Minoru Teshigawara, Urawa; Toshiyuki Chikuma, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/538,301

(22) Filed: Mar. 30, 2000

(30) Foreign Application Priority Data

Apr. 2, 1999 (JP) ..... 11-097052

(51) Int. Cl.[7] ..... B41J 29/393
(52) U.S. Cl. ..... 347/19; 347/19
(58) Field of Search ..... 347/19; 250/205, 250/208.1, 559.06, 559.4, 559.36

(56) References Cited

U.S. PATENT DOCUMENTS

| | | | | | |
|---|---|---|---|---|---|
| 4,313,124 | A | | 1/1982 | Hara | 347/57 |
| 4,345,262 | A | | 8/1982 | Shirato et al. | 347/10 |
| 4,459,600 | A | | 7/1984 | Sato et al. | 347/47 |
| 4,463,359 | A | | 7/1984 | Ayata et al. | 347/56 |
| 4,558,333 | A | | 12/1985 | Sugitani et al. | 347/65 |
| 4,608,577 | A | | 8/1986 | Hori | 347/66 |
| 4,723,129 | A | | 2/1988 | Endo et al. | 347/56 |
| 4,740,796 | A | | 4/1988 | Endo et al. | 347/56 |
| 5,239,316 | A | * | 8/1993 | Demarchi et al. | 347/33 |
| 5,808,296 | A | * | 9/1998 | McMonagle et al. | 250/221 |
| 6,014,159 | A | * | 1/2000 | Yamaguchi et al. | 347/171 |
| 6,027,200 | A | | 2/2000 | Takahashi et al. | 347/19 |
| 6,036,298 | A | * | 3/2000 | Walker | 347/19 |
| 6,109,721 | A | * | 8/2000 | Kim | 347/19 |
| 6,109,722 | A | * | 8/2000 | Underwood et al. | 347/19 |

FOREIGN PATENT DOCUMENTS

| | | |
|---|---|---|
| JP | 54-056847 | 5/1979 |
| JP | 59-123670 | 7/1984 |
| JP | 59-138461 | 8/1984 |
| JP | 60-71260 | 4/1985 |
| JP | 10-329381 | 12/1998 |

* cited by examiner

*Primary Examiner*—John Barlow
*Assistant Examiner*—Julian D. Huffman
(74) *Attorney, Agent, or Firm*—Fitzpatrick, Cella, Harper & Scinto

(57) ABSTRACT

A construction of a printing apparatus wherein a printing registration with respect to forward and reverse scans of a printing head and a printing registration with respect to a plurality of printing heads are automatically carried out is realized without rendering the apparatus complex or causing its production cost to rise. To this end, the optical sensor for measuring patterns formed for use in printing registration is also used to serve other purposes such as a detection of a printing home position or a detection of a printing medium's end. Furthermore, by appropriately controlling a single optical sensor according to each of various intended purposes, the optimum characteristics are utilized in each respective operating mode. Because of the above, the addition of sensors to be used only for the purpose of printing registration and the accompanying rise of the print apparatus production cost are restrained.

11 Claims, 21 Drawing Sheets

PRINTING APPARATUS AND A PRINTING REGISTRATION METHOD

This application is based on Japanese Patent Application No. 11-097052 (1999) filed Apr. 2, 1999, the content of which is incorporated hereinto by reference.

BACKGROUND OF THE INVENTION

1. Field of the Invention

The present invention relates to a printing apparatus and a printing registration method, and more specifically this invention seeks to simplify the construction for printing registration during performing printing in the bi-directions of a forward scan and a reverse scan of a printing head and/or for alignment among printing heads during performing printing using a plurality of printing heads.

2. Description of the Related Art

Conventionally, printing registration in a printing apparatus for forming images by dots has generally been performed as described below.

For example, in the case of printing registration in a forward scan and a reverse scan, relative printing registration conditions for the forward scan and the reverse scan are changed by adjusting the printing timing for the forward scan and for the reverse scan to perform bi-directional scanning in their respective printing registration conditions, thereby printing ruled lines on a printing medium. Then a person such as a user observes the printed results and selects the printing conditions leading to the best registration, thereby setting the printing conditions for registration in a device such as a printing apparatus or a host computer.

In performing registration among heads in the case of a printing apparatus having a plurality of heads, relative printing registration conditions are changed, and ruled lines are printed by means of respective heads, then similarly to the manner mentioned above, a person such as a user selects the conditions leading to the best registration, thereby establishing the printing registration conditions in a device such as a printing apparatus or a host computer.

However, in the case of such a printing registration processing method, complexity is involved in that the user is required to visually observe the printed results, to select the optimum dot-depositing registration conditions, and to carry out data entry operation. Furthermore, fundamentally, because a judgment for obtaining the optimum printing position by observing through human eyes is required by the user, the optimum registration is not necessarily set. Therefore, it is especially unfavorable to the user who is not accustomed to such operation.

Moreover, the user is enforced to expend in time and effort at least two times since the user should print the image to perform the depositing registration and, in addition, to perform conditional establishment after observing the user must perform judgments, whereby upon realizing the apparatus or system is excellent in operability, it is not only undesirable but also is disadvantageous from the viewpoint of time consumption.

In Japanese Patent Application Laid-Open No. 10-329381 (1998), the present applicant proposed an improved method whereby a device or a system capable of printing high-speed and high-quality images without causing any such operational problems is realized at a low cost.

The system under this improved method in a printing apparatus for performing printing on a printing medium by using a printing head comprises means for controlling the printing head to form a plurality of patterns, the plurality of patterns being respectively formed corresponding to a plurality of shifting amounts of relative printing positions of a first printing and a second printing to be registered and the plurality of patterns respectively having optical characteristics corresponding to the plurality of shifting amount, means for measuring respective optical characteristics of the plurality of the formed patterns, and means for performing printing registration processing between the first printing and the second printing on the basis of the respective optical characteristics of a plurality of patterns measured by the optical characteristics measurement means.

SUMMARY OF THE INVENTION

This invention intends to simplify the construction for performing such printing registration. Specifically, an object of the present invention is to avoid addition of a sensor to be used in the means for measuring optical characteristics during the printing registration operation which is considered to be applied with a relatively little use frequency, and thereby to restrain the resulting rise of the production cost of the printing apparatus.

Furthermore, another object of the present invention is to restrain the complexity of the construction of the peripheral circuits which results from the increase of the number of sensors installed in the printing apparatus, namely to restrain factors such as the increase of the number of amplification circuits, reference voltage circuits, and input ports connected to sensors, thereby conducing to a reduction of the cost of printing apparatuses capable of performing printing registration.

In a first aspect of the present invention, there is provided a printing apparatus for performing printing on a printing medium by using a printing head, comprising:

means for controlling the printing head to form a plurality of patterns, the plurality of patterns being respectively formed corresponding to a plurality of shifting amounts of relative printing positions of a first printing and a second printing to be registered and the plurality of patterns respectively having optical characteristics corresponding to the plurality of shifting amounts;

optical measuring means for measuring respective optical characteristics of the plurality of patterns;

means for performing printing registration processing between the first printing and the second printing on the basis of the respective optical characteristics of the plurality of patterns measured by the optical measuring means; and means for performing a detecting operation distinct from the measurement of the optical characteristics by using the optical measuring means.

In a second aspect of the present invention, there is provided a printing apparatus for performing printing on a printing medium by a first printing and a second printing by using a printing head, comprising:

means for measuring respective optical characteristics of a pattern used for performing a printing registration between the first printing and the second printing; and means for performing a detecting operation distinct from the measurement of the optical characteristics by sing the measuring means.

In a third aspect of the present invention, there is provided a printing registration method for a printing apparatus for performing printing on a printing medium by using a printing head, the method comprising the steps of:

controlling the printing head to form a plurality of patterns, the plurality of patterns being respectively formed corresponding to a plurality of shifting amounts of relative printing positions of a first printing and a second printing,to be registered and the plurality of patterns respectively having optical characteristics corresponding to the plurality of shifting amounts;

measuring the respective optical characteristics of the plurality of patterns by using optical measuring means;

performing printing registration processing between the first printing and the second printing on the basis of the respective optical characteristics of the plurality of patterns measured by the optical measuring means; and performing a detecting operation distinct from the measurement of the optical characteristics by using the optical measuring means.

In a fourth aspect of the present invention, there is provided a printing registration method for a printing apparatus for performing printing on a printing medium by a first printing and a second printing by using a printing head, comprising:

measuring respective optical characteristics of a pattern used for performing a printing registration between the first printing and the second printing by using optical measuring means; and performing a detecting operation distinct from the measurement of the optical characteristics by using the optical measuring means.

In a fifth aspect of the present invention, there is provided a printing system provided with a printing apparatus for performing printing on a printing medium by using a printing head, and a host apparatus for supplying image data to the printing apparatus, comprising:

means for controlling the printing head to form a plurality of patterns, the plurality of patterns being respectively formed corresponding to a plurality of shifting amounts of relative printing positions of a first printing and a second printing to be registered and the plurality of patterns respectively having optical characteristics corresponding to the plurality of shifting amounts;

optical measuring means for measuring respective optical characteristics of the plurality of patterns;

means for performing printing registration processing between the first printing and the second printing on the basis of the respective optical characteristics of the plurality of patterns measured by the optical measuring means; and means for performing a detecting operation distinct from the measurement of the optical characteristics by using the optical measuring means.

In the construction of the present invention, only the required functions are added without requiring any new sensors to be added, for example, by executing frequently used functions and infrequently used functions with a single sensor used in common and by using the sensor for each individual operating mode of the printing apparatus on a time division basis. Moreover, it is made possible using the same sensor to exhibit different characteristics by switching control such that the optimum sensor function for each operating mode is activated.

Incidentally, hereafter, the word "print" (hereinafter, referred to as "record" also) represents not only forming of significant information, such as characters, graphic images or the like but also represents forming images, patterns and the like on the printing medium irrespective of whether they are significant or not and whether the formed image is to be visually perceptible or not, in a broad sense, and further includes the case where the medium is processed.

Here, the wording "printing medium" represents not only paper typically used in the printing apparatus but also cloth, plastic film, a metal plate and the like and any substance which can accept the ink in broad sense.

Furthermore, the wording "ink" has to be understood in broad sense similarly to the definition of "print" and should include any liquid to be used for formation of image patterns and the like or for processing of the printing medium.

In this specification, optical density, that is to say, reflection optical density using reflection factor or transmission optical density using transmission coefficient, is used as optical characteristics. However, optical reflection factor and reflected light intensity can also be used. In this specification, the term of "reflection optical density" is abbreviated to "optical density" or simply to "density" except for confusion.

The above and other objects, effects, features and advantages of the present invention will become more apparent from the following description of embodiments thereof taken in conjunction with the accompanying drawings.

BRIEF DESCRIPTION OF THE DRAWINGS

FIGS. 7A to 7C are schematic views respectively illustrating an example of printing patterns for use in an embodiment according to the present invention, wherein FIG. 7A illustrates dots in the case where the printing positions are well registered; FIG. 7B, where the printing positions are registered with a slight offset; and FIG. 7C, where the printing positions are registered with a greater offset;

FIGS. 8A to 8C are schematic views respectively illustrating another example of patterns for printing registration for use in another embodiment according to the present invention, wherein FIG. 8A illustrates dots in the case where the printing positions are well registered; FIG. 8B, where the printing positions are registered with a slight offset; and FIG. 8C, where the printing positions are registered with a greater offset;

DETAILED DESCRIPTION OF THE PREFERRED EMBODIMENTS

1. Summary of Embodiments

Figure 1:
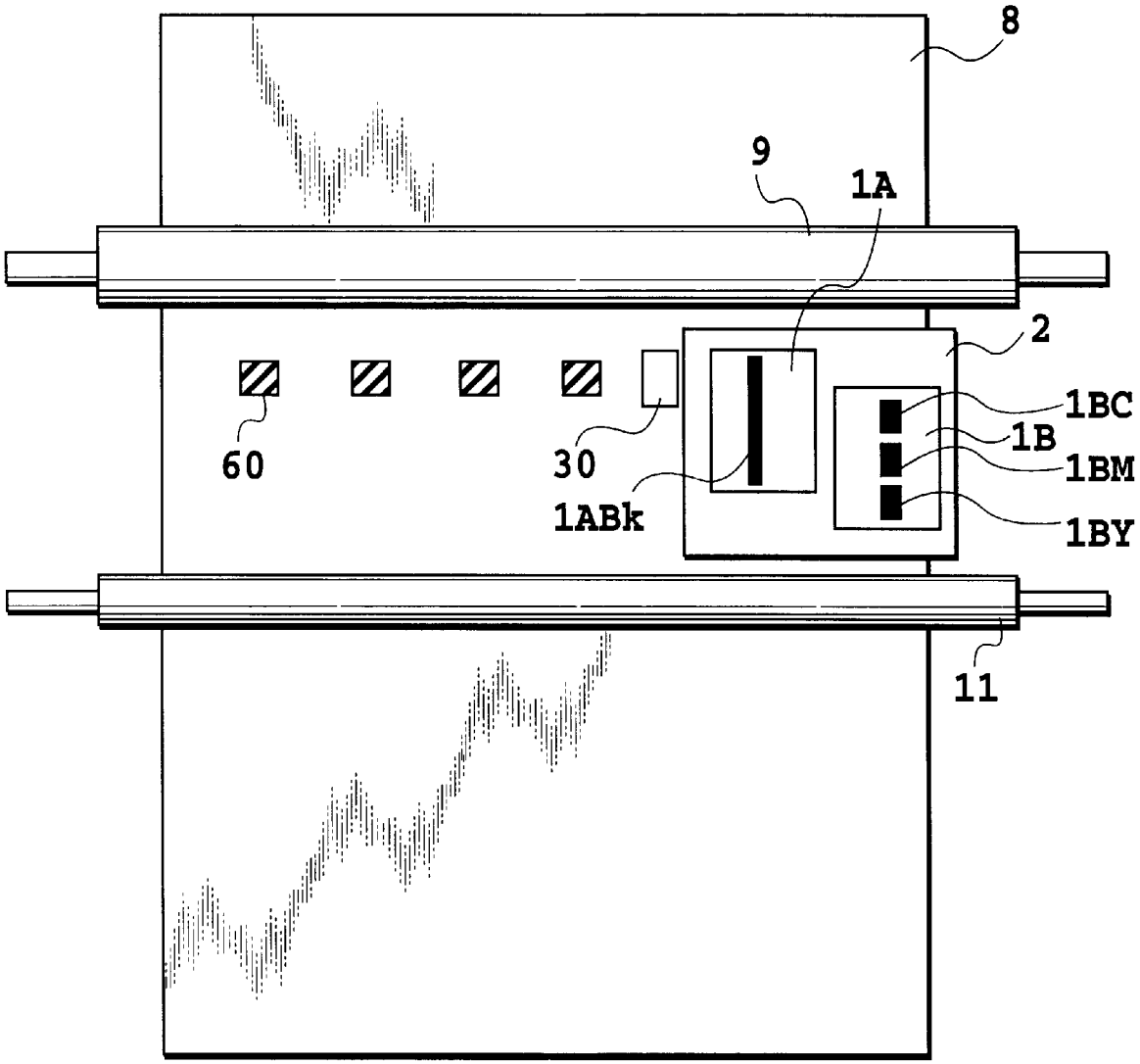
FIG. 1 is a schematic plan view showing an example of an overview construction of an ink jet printing apparatus relating to a preferred embodiment of the present invention.

In an adjustment method (printing registration) of a dot formation position (an ink-depositing position) and a printing apparatus according to embodiments of the invention, a forward printing and a reverse printing (a first and a second printing, respectively) in a bi-directional printing for which an adjustment of the dot formation position should be performed mutually, or respective printing (a first printing and a second printing) by a plurality of print heads (e.g., two heads), are on the substantially same position on a printing medium. In addition, printing is performed thereon, varying registration conditions of the relative dot formation position, under a plurality of conditions upon the first printing and the second printing. Namely, by varying the relative position condition of the first and the second printing, a pattern including a plurality of patches described below is formed.

Moreover, the density of respective printing patterns is read by means of an optical sensor having lower resolution than that of the printing, and the conditions for the most closely registered printing positions are calculated from the relative relation of these density values. This calculation depends on what sort of patterns are to be printed.

When printing registration is to be performed in a forward scan and a reverse scan in a serial printing apparatus wherein a printing head is subjected to bi-directional scanning (main scanning) with respect to the printing medium to form images in the forward and reverse scans, the following is used as a printing pattern used for processing the printing registration, or as a first printing pattern element in the forward scan and a second printing pattern element in the reverse scan for forming the printing pattern.

A printing pattern resulting from bi-directional printing performed under ideal registration condition is one wherein the scan-wise distance between a print dot due to a forward scan and a print dot due to a reverse scan is preferably between 50% and 100% of the formed dot diameter and wherein the average density decreases with increasing amount of mutual position offsetting. By using this pattern, the results of the reading of the average density of the area on which printing is performed (hereinafter referred to as the printed area) can be reflected in the judgment as to whether printing registration is achieved. Printing registration condition can be established by performing calculation on the basis of the density measured, for example, by means of an optical sensor mounted on a carriage.

As regards the method of establishing the conditions, predetermined calculation is performed on the basis of a density distribution for a plurality of printing registration conditions, thereby making it possible to establish the condition for the best printing registration. Moreover, in the case of a construction for which simpler calculation is performed because no high precision is required for printing registration, the printing condition under which a pattern exhibiting the highest density is printed may be chosen as the printing registration condition.

As for other printing patterns, the following can be also used. When printing is performed under ideal registration conditions, the first printing pattern element in printing in a forward scan and the second printing pattern element in printing in a reverse scan are such that the print dots formed during respective scannings are most overlapped with each other. With this pattern, dots overlapping each other are offset according to offsetting of mutual registration conditions, resulting in increased average density of the printed area. By using this pattern as well, the results of the reading of the average density of the printed area can be reflected in the judgment as to whether printing registration is achieved. Thus, as in the above case, the printing registration condition can be established by performing calculation on the basis of the density measured, for example, by means of an optical sensor mounted on a carriage.

As regards the method of establishing the conditions, the predetermined calculation is performed on the basis of a density distribution for a plurality of registration conditions, thereby making it possible to establish the condition for the best printing registration. Moreover, in the case of this embodiment, when simpler calculation is to be performed, the printing condition under which a pattern exhibiting the lowest density is printed may be chosen as the registration condition.

Whichever of these two embodiments is adopted, in order to perform forward and reverse printing registration with high precision, it is desirable that the density of a printed area on the printing medium change greatly according to the change of printing registration conditions. For this purpose, it is extremely desirable that the main-scan-wise print dot spacing for pattern elements printed in a forward scan and in a reverse scan respectively is of an appropriate dimension with respect to the diameter of the dots. On the other hand, the dot diameter changes, in the case of an ink jet type printing apparatus for example, depending on factors such as the characteristics of the printing medium, the type of ink, and the volume of ink ejected, for instance, in drops from the printing head. Therefore, prior to printing a pattern for the purpose of printing registration, a plurality of predetermined printing patterns with varied main-scan-wise dot spacing are printed, and readings of the optical densities are taken, on the basis of which dot diameters are determined, thereby making it possible to adjust dot spacing to be used during the formation of patterns for printing registration. By doing so, appropriate printing registration can be performed regardless of factors such as the types of printing medium and ink as well as the size of ink drops.

Furthermore, in order to perform bi-directional printing registration with high precision, it is desirable that sufficient graduations be available for the optical sensor output. For this purpose, it is extremely desirable that the printed area density for printing registration is distributed within certain predetermined limits. This is because, for example, when printing is performed in black ink on a printing medium having intense color-developing characteristics, it is conceivable that there are cases where the printed area becomes too black for the absolutely needed quantity of reflected light to be available, thus failing to obtain sufficient output from optical sensors. Therefore, prior to printing a pattern for the purpose of printing registration, a plurality of predetermined printing patterns are printed, and readings of the resulting optical densities are taken, from that the resulting color-developing characteristics are evaluated. On the basis of this evaluation, it is also possible to adjust the density by thinning out dots or by doubly printing dots.

By way of another method, reference patterns exhibiting different densities may be printed, then the output at the light emitting portion of the optical sensor may be adjusted or the sensitivity of the photosensing portion may be adjusted, such that the optimum linear characteristics for the pertinent pattern will be exhibited.

As regards the preferred embodiments of the present invention, the optical sensor for reading the pattern density during printing registration processing is described with consideration given to a sensor used in common both as one for detecting the home position of a carriage on which a printing head is mounted and which is subjected to main scanning and as one for detecting the end of a printing medium subjected to sub scanning or feeding. It is a matter of course, however, that the description applies to any other sensor which serves in common as a third sensor and as either one of the two sensors. Moreover, in the preferred embodiments of the present invention, any optical sensor used in common in different modes as mentioned above can be put to optimum use by switching the control method for each individual mode in a series of processing.

Specific embodiments of the present invention are explained in detail by referring to drawings. Furthermore, an explanation is given regarding a case where the present invention is applied primarily to an ink jet printing apparatus and to a printing system using this printing apparatus. Moreover, in each of the drawings referred to, any element indicated by an identical symbol denotes an identical or corresponding element.

This preferred embodiment pertains to a printing method in which a forward scan and a reverse scan are performed with respect to a single printing head, and complementary printing is performed in respective scans to form images, and performs printing position registration between a forward scan and a reverse scan. Moreover, as regards this example, an explanation is given on a case where one type of printing medium is used. Furthermore, the optical sensor for reading the pattern density during printing registration processing is explained by taking into consideration a case where the sensor is used in common as a home position sensor (HP sensor) and as a paper end sensor (PE sensor). However, it is a matter of course that the present invention is not limited to these cases.

2. Construction Example of a Printing Apparatus

FIG. 1 is a drawing showing a construction example of the main areas of a preferred embodiment of an ink jet printing apparatus to which the present invention is applied.

In FIG. 1, a plurality of head cartridges (two pieces) 1A and 1B are mounted on a carriage 2 in such a way as to permit installation and removal. Each of the cartridges 1A and 1B has a printing head portion and an ink tank portion, and moreover, a connector is provided for the purpose of transmitting and receiving signals between each head cartridge and a printing apparatus control portion to drive the head portion (not shown).

The head cartridge 1A serves to perform printing, for example, in black (Bk) ink, and the head cartridge 1B serves to perform printing in inks of distinctly different colors, and in each of the corresponding ink tank portions is contained ink of a different color such as cyan (C), magenta (M), and yellow (Y). Furthermore, in the case of this embodiment, the head cartridge 1A having a Bk ink ejection portion 1ABk where nozzles for ejecting Bk ink are arrayed and the head cartridge 1B where a group of nozzles 1BY, 1BM, and 1BC for ejecting Y ink, M ink, and C ink, respectively, are arrayed integrally and an inline manner according to a range of arraying the Bk ink ejection openings are placed side by side.

Each head cartridge is appropriately positioned on a carriage 2 and mounted in such a way as to permit installation and removal. On the carriage 2 is mounted a connector holder (electrical connection portion; not shown) for transmitting drive signals and the like to each of the head cartridges 1A and 1B. The carriage 2 is supported in such a way as to permit forward and reverse movements in the direction of main scanning (laterally with respect to the drawing). Moreover, a reflection type optical sensor 30 is located on the carriage 2.

A printing medium 8 such as printing paper or a thin plastic sheet is conveyed (paper feeding) through a position (printing portion) opposite the ejection opening surface of the head cartridges 1A and 1B on account of the rotation of two sets of conveyance rollers (line feed rollers) 9 and 11. Moreover, the back of the printing medium 8 is supported by a platen 20 (FIGS. 16A and 16B) such that a flat printed surface will be formed in a printing area. In this case, each of the head cartridges 1A and 1B mounted on the carriage 2 is held such that the pertinent ejection opening surface is protruded downwardly from a bottom portion of the carriage 2 and is in parallel with the printing medium 8 between the two sets of conveyance rollers.

Each of the head cartridges 1A and 1B has ejection portions 1ABk and 1BY through 1BC, which eject ink by making use of thermal energy (hereinafter collectively referred to as printing head 1), and each ejection portion comprises electrothermal converting elements for generating thermal energy. Namely, the printing head 1 causes film boiling in ink on account of the heat generated by applying electricity to the electrothermal converting element, and ejects ink from the ejection opening by utilizing the resulting bubble pressure, thereby performing printing. Moreover, reference numeral 60 denotes the pattern printed on the printing medium for printing registration purposes.

Figure 2:
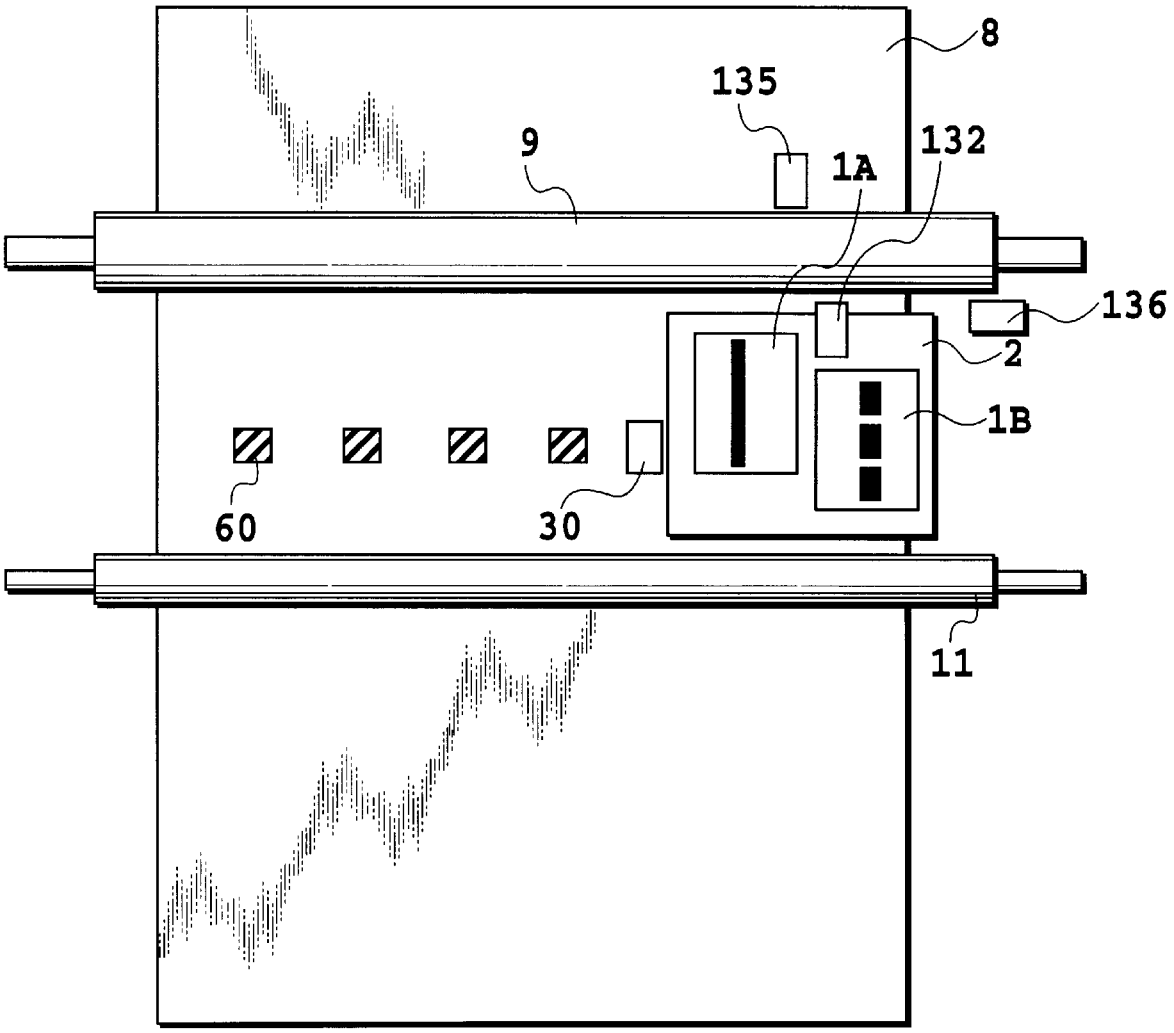
FIG. 2 is a schematic plan view showing an example of an overview construction of an ink jet printing apparatus wherein a plurality of optical sensors are installed, each sensor serving a distinct function.

FIG. 2 shows the construction of a printing apparatus which is different from the one in FIG. 1. Namely whereas a single optical sensor 30 is provided in the case of the example in FIG. 1, a paper end sensor (PE sensor) 135, a home position sensor (HP sensor) 132, and a shield 123 for activating the home position sensor 132 are provided in FIG. 2, resulting in increased number of components.

Figure 3:
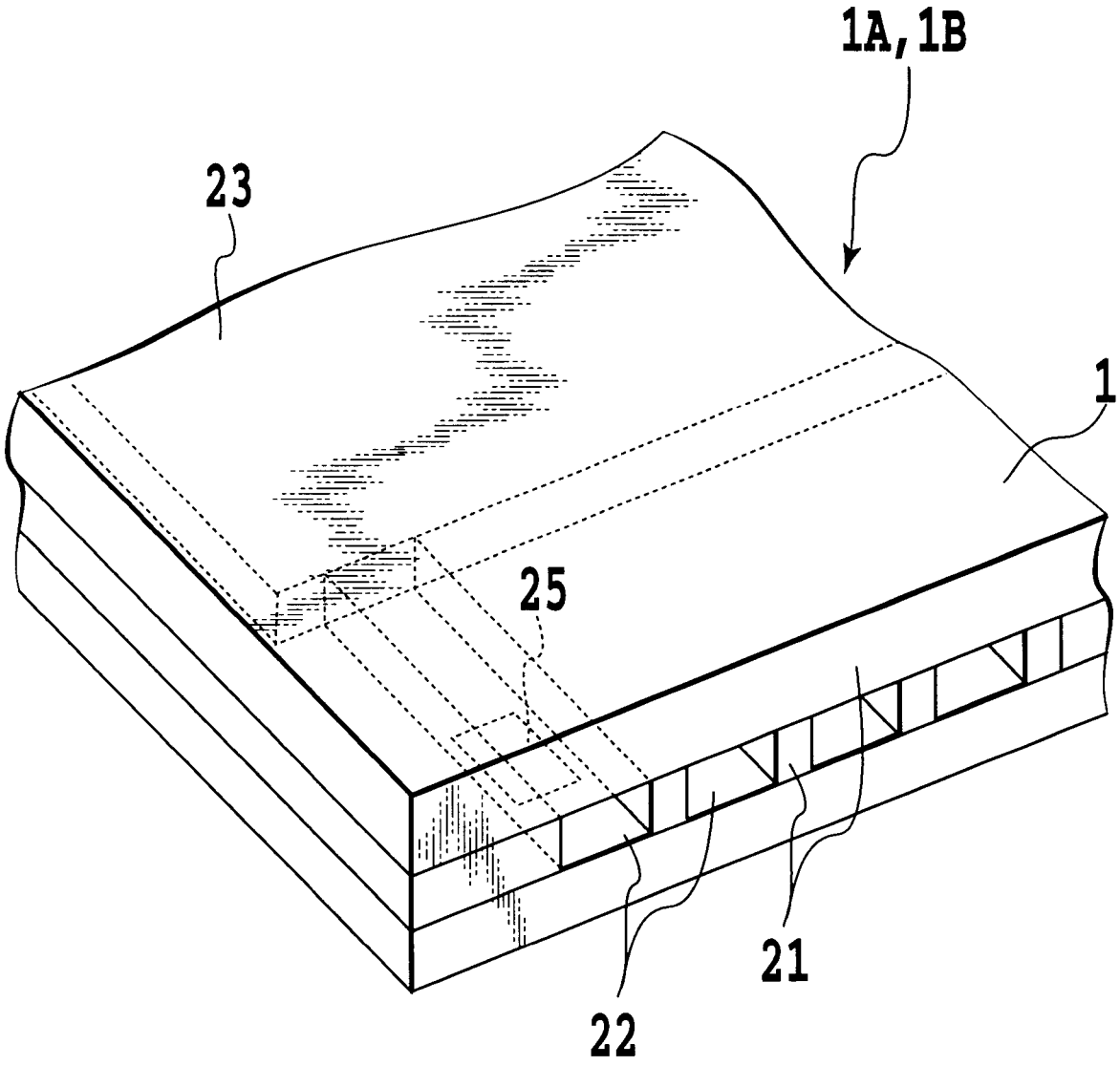
FIG. 3 is a perspective view showing a constitution example of a main portion of a printing head in a head cartridge shown in FIG. 1 or 2.

FIG. 3 is a schematic perspective-view partially showing a structure of a main portion of the printing head portion 1 of the head cartridge 1A or 1B.

A plurality of ejection openings 22 are formed with predetermined pitches in the ejection opening face 21 facing the printing medium 8 with a predetermined clearance (for example, approximately 0.5 to 2.0 mm) in FIG. 3, and along a wall surface of each of liquid passages 24 communicating a common liquid chamber 23 with each ejection opening 22, the electrothermal converting elements (heating resistant element and so on) for generating the energy used for ejecting ink are arranged. In this embodiment, each of the head cartridges 1A and 1B is installed on the carriage 2 under the positional relationship so that the ejection openings 22 stand in a line in the direction which crosses a scanning direction of the carriage unit 2. Thus, each of the head cartridges 1A and 1B has the ejection portion in that the corresponding heating resistor elements (hereinafter referred to an ejecting heaters) 25 are driven (energized) based on the image signal or ejection signals and to film-boil ink within the liquid passages 24 and to eject the ink from the ejection openings 22 by pressure of the bubbles which are generated by film-boiling.

Figure 4:
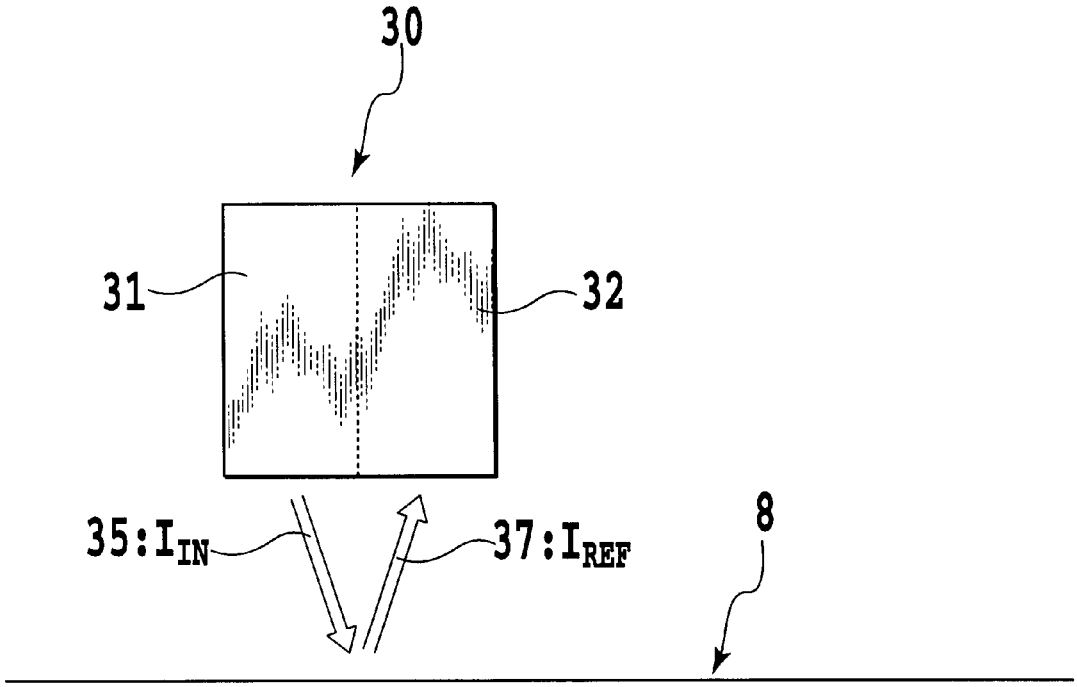
FIG. 4 is a schematic view describing an optical sensor being used in the apparatus shown FIG. 1 or 2.

FIG. 4 is a schematic view describing a reflection type optical sensor 30 being used in the apparatus shown in FIG. 1 or 2.

The reflection type optical sensor 30 is mounted on the carriage 2 as described above, and comprises a light-emitting portion 31 and a photosensing portion 32 as shown in FIG. 4. An incident light Iin 35 which is emitted from the light-emitting portion 31 is reflected on the printing medium 8, and the reflected light Iref 37 can be detected by the photosensing portion 32. Moreover, the detected signal is transferred to a control circuit formed on an electric board of the printing apparatus through a flexible cable (not shown), and is converted into a digital signal by the A/D converter. The position at which the reflective optical sensor 30 is attached to the carriage 2 is set at the position where the ejection portions of the head cartridges 1A and 1B do not pass in order to prevent splashed droplets of ink or the like from depositing, during printing scanning. This sensor 30 can be a sensor of low cost because a sensor of relatively low resolution can be used.

Figure 5:
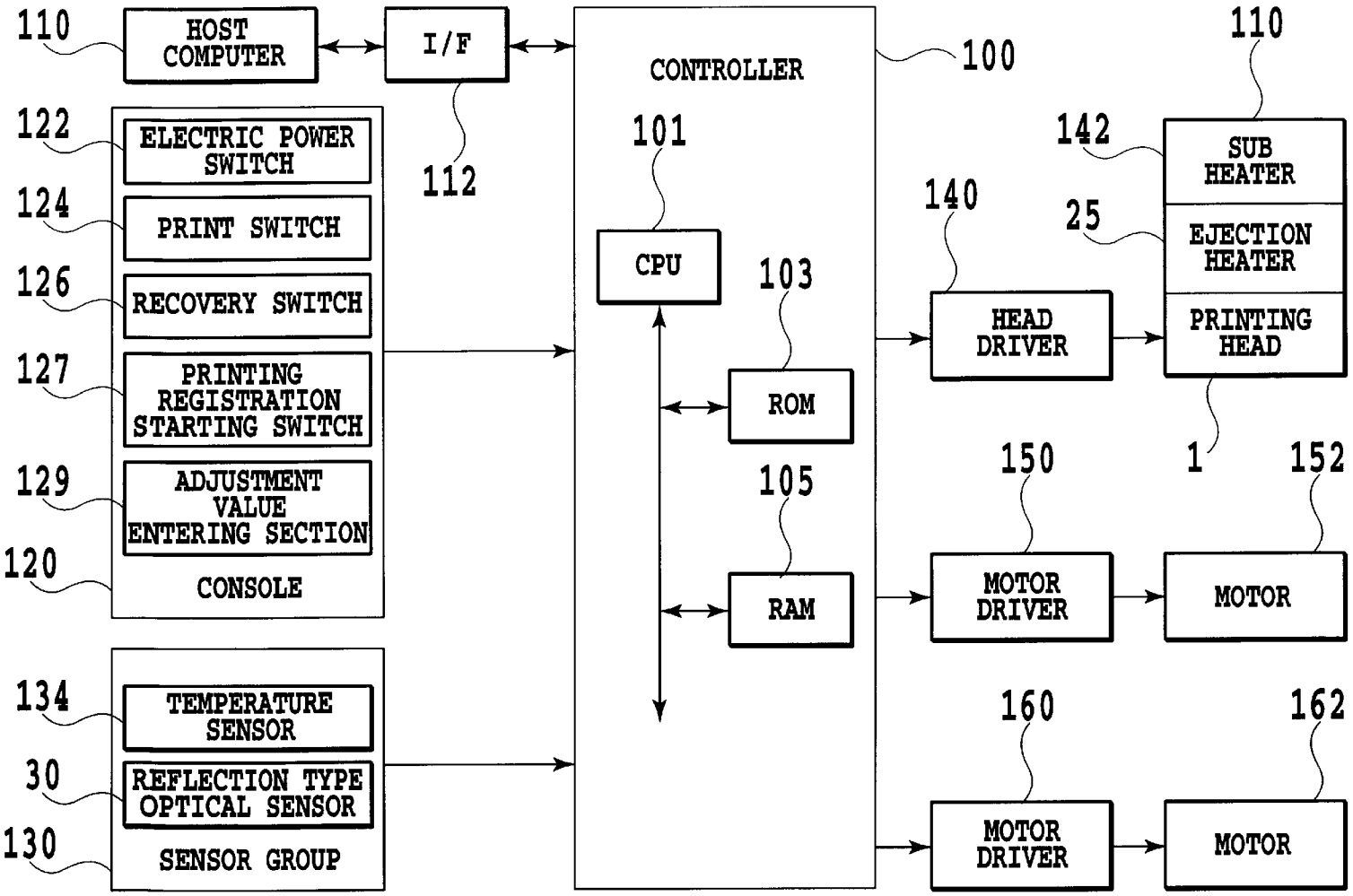
FIG. 5 is a block diagram showing a schematic constitution of a control circuit in the ink jet printing apparatus according to an embodiment of the invention.

FIG. 5 is a block diagram showing a schematic constitution of a control circuit in the ink jet printing apparatus according to one embodiment of the invention.

In FIG. 5, a controller 100 is a main control section and, for example, comprises MPU 101 of a microcomputer form, ROM 103 in which a program, a table required and the other fixed data are stored, a dynamic RAM having an area for developing image data, a working area, and so on. A host apparatus 10 is a source of supply of the image data (a computer performing preparation of data and processing for printing is used, as well as the apparatus may be a form of a reader unit or the like for reading the image also). The image data, the other commands, a status signal or the like are transmitted to controller 100 and are received from controller 100 through the interface (I/F) 112.

A console 820 has a switch group which receives indicative input by an operator, and comprises a power supply switch 122, switch 124 for indicating commencement of printing, a recovery switch 126 for indicating starting of the suction recovery, a printing registration starting switch 127 for starting the printing registration by a manual operation and an adjustment value set entering section 129 for entering the adjustment value by a manual operation.

Figure 6:
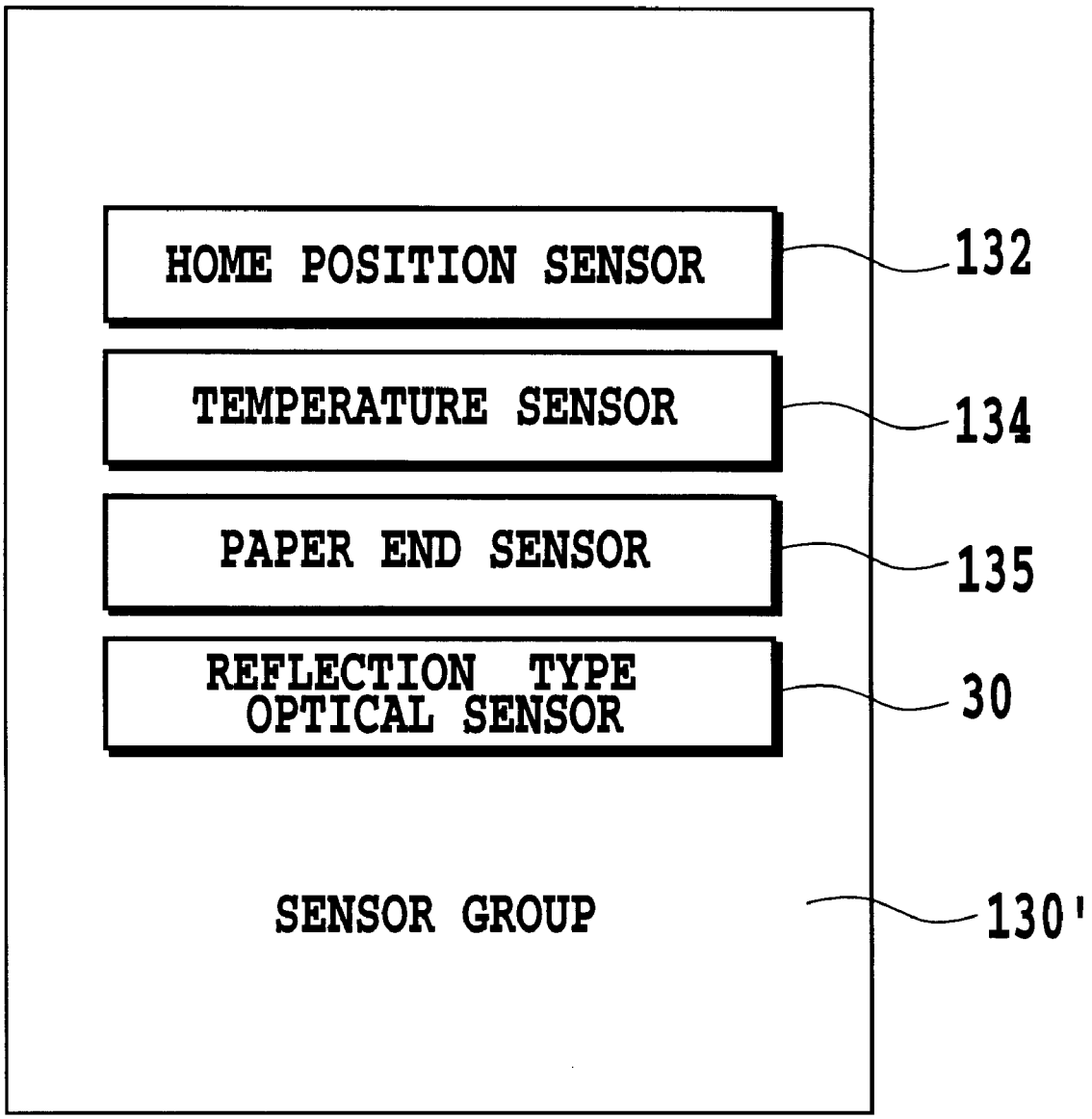
FIG. 6 is a block diagram showing a constitution of a sensor group in the ink jet printing apparatus shown in FIG. 2.

A sensor group 130 serves to detect the status of the apparatus, and has components such as the reflection type optical sensor 30 and a temperature sensor 134 located in appropriate places to detect the environmental temperature. In contrast with such the sensor group 130, in the event that a construction shown in FIG. 2 is adopted, a sensor group 130' to which a home position sensor 132 and a paper end sensor 135 are added is required as shown in FIG. 6, and in addition to the above, not only a shield for activating the home position sensor 132 but also electrical circuits for components such as amplifiers for the relevant sensors are to be added.

A head driver 140 serves to drive the ejection heater 25 of the printing head 1 depending on the information such as the print data. The head driver 140 has components such as a shift register for arraying the print data according to the position of the ejection heater 25, a latch circuit for performing latching at appropriate timing, a logical circuit element for activating the ejection heater synchronously with drive timing signals, and in addition a timing setting portion appropriately establishing the drive timing (ejection timing) for the purpose of dot forming registration.

The printing head 1 is provided with a sub-heater 142. The sub-heater 142 serves to perform temperature adjustment for the purpose of stabilizing the ejection characteristics of ink. The sub-heater may be formed on the printing head board simultaneously with the ejection heater 25 and/or may be installed on the printing head body or the head cartridge.

Reference numeral 150 denotes a driver for driving, for example, the main scanning motor 152 in the form of a pulse motor; reference numeral 162, a motor used to feed (sub-scan) the printing medium 8; and reference numeral 160, the driver for the motor 162.

3. Printing Pattern for Printing Registration

In the following explanation, the ratio of the region printed by a printing apparatus to a predetermined region on the printing medium is referred to as an "area factor." For example, the area factor is 100% if dots are formed throughout the predetermined region on the printing medium, the area factor is 0% if no dots are formed, and the area factor is 50% if the printed area is half the pertinent area.

Figure 7A:
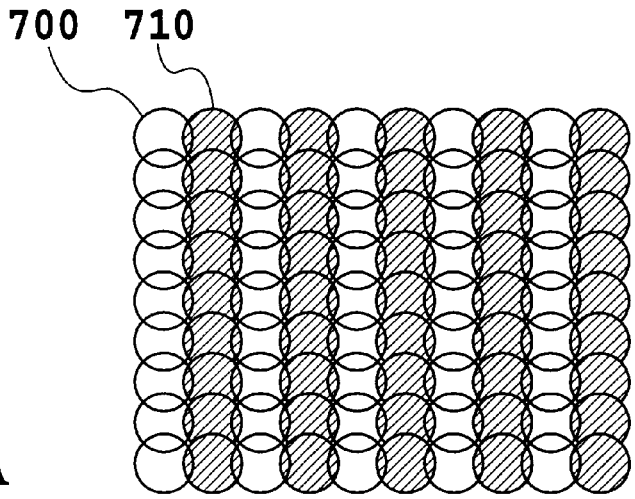
Figure 7B:
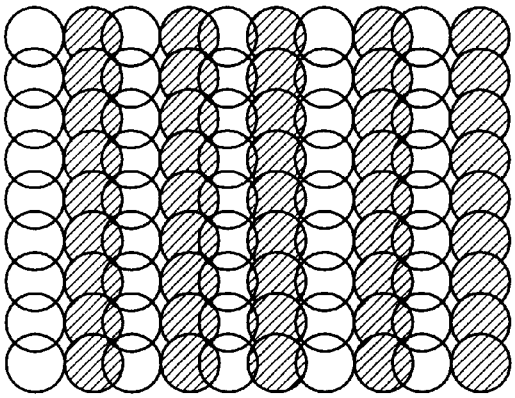
Figure 7C:
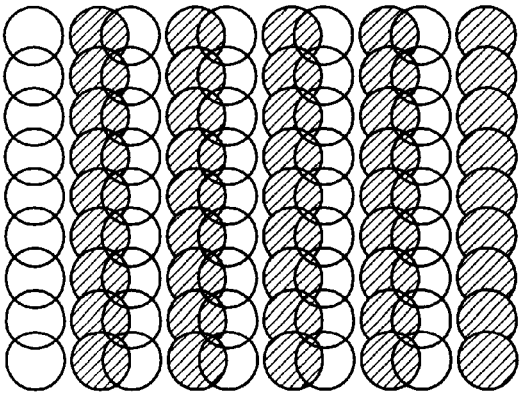

FIGS. 7A to 7C are schematic drawings showing printing patterns for printing registration used in the preferred embodiments of the present invention.

In FIGS. 7A to 7C, white dots 700 represent dots formed on the printing medium during the forward scan (first printing) and hatched dots 710 represent dots formed on the printing medium during the reverse scan (second printing). It should be noted that although in FIGS. 7A to 7C the dots are hatched or not for the purpose of illustration, the dots are formed with the ink ejected from the same printing head, irrespective of the color or density of the ink. FIG. 7A shows the dots printed in the state in which printing positions in the forward scan and the reverse scan are well registered; FIG. 7B, the printing positions are registered with a slight offset;

and FIG. 7C, the printing positions are registered with a greater offset. As is obvious from the FIGS. 7A to 7C, in the present embodiment, the dots are complementarily formed in the forward and reverse scan. Namely, the dots in the odd number of columns are formed in the forward scan, and the dots in the even number of columns are formed in the reverse scan. Accordingly, FIG. 7A, in which the dots formed in the forward scan and the reverse scan are separated by about the diameter of the dot, shows the well registered state.

The printing pattern is designed to reduce the density of the overall printed portion as the printing position is offset. Namely, within a range of a patch as the printing pattern of FIG. 7A, the area factor is about 100%. As the printing positions are offset as shown in FIGS. 7B and 7C, the overlapping amount of the dot (white dot) of the forward scan and the dot (hatched dot) of the reverse scan becomes greater to enlarge the not-printed region, i.e., a region not formed with the dots, thereby decreasing the area factor so as to reduce the density on average.

In the present embodiment, the printing positions are offset by shifting the timing of printing. It is possible to offset on printing data.

In FIGS. 7A to 7C, although one dot in the scanning direction is taken as a unit, a unit may be appropriately set according to precision of printing registration or precision of printing registration detection.

Figure 8A:
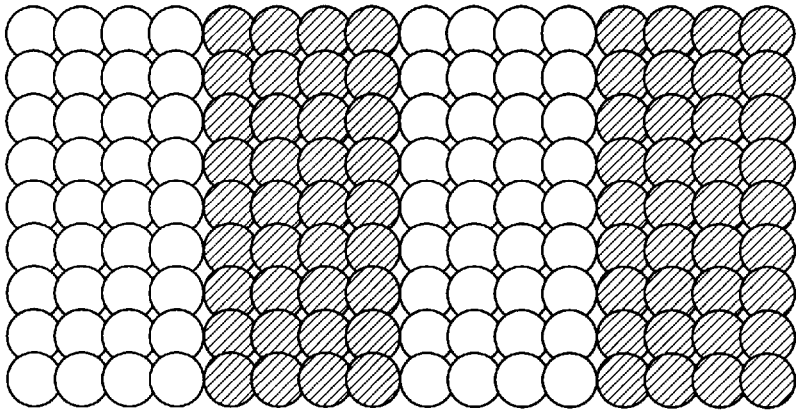
Figure 8B:
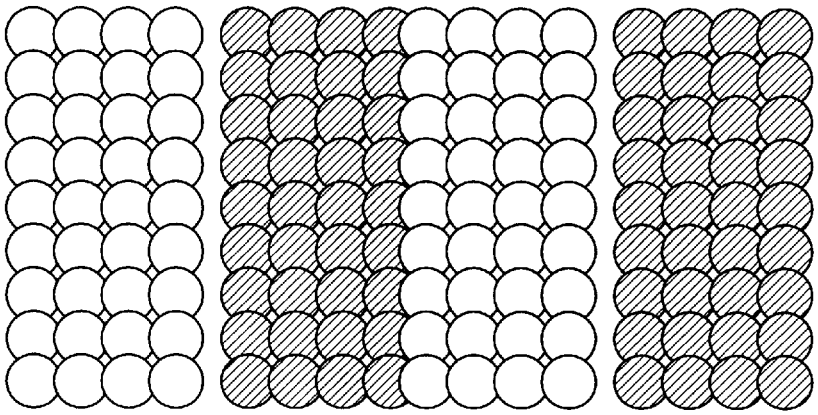
Figure 8C:
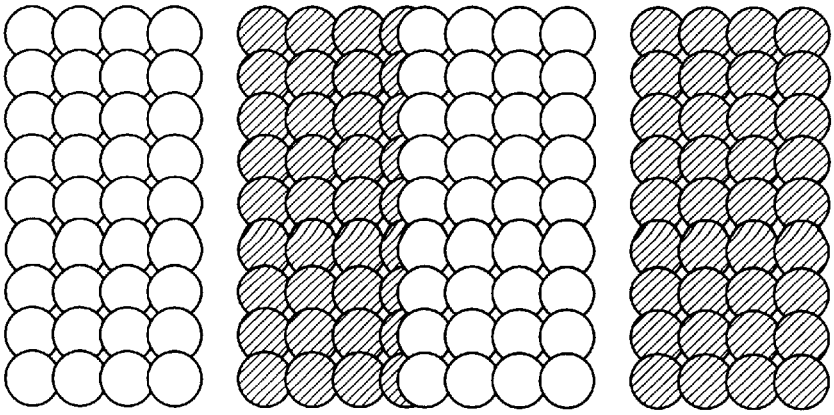

FIGS. 8A to 8C show the case where four dots are taken as a unit. FIG. 8A shows the dots printed in the state in which printing positions in the forward scan and the reverse scan are well registered; FIG. 8B, the printing positions are registered with a slight offset; and FIG. 8C, the printing positions are registered with a greater offset.

What is intended by the above pattern is that the area factor is reduced with respect to an increase in mutual offset of the printing positions in the forward scan and the reverse scan. This is because the density of the printed portion is significantly dependent on variations of the area factor. Namely, although the dots are overlapped with each other so as to increase the density, an increase in not-printed region has a greater influence on the average density of the overall printed portion.

Figure 9:
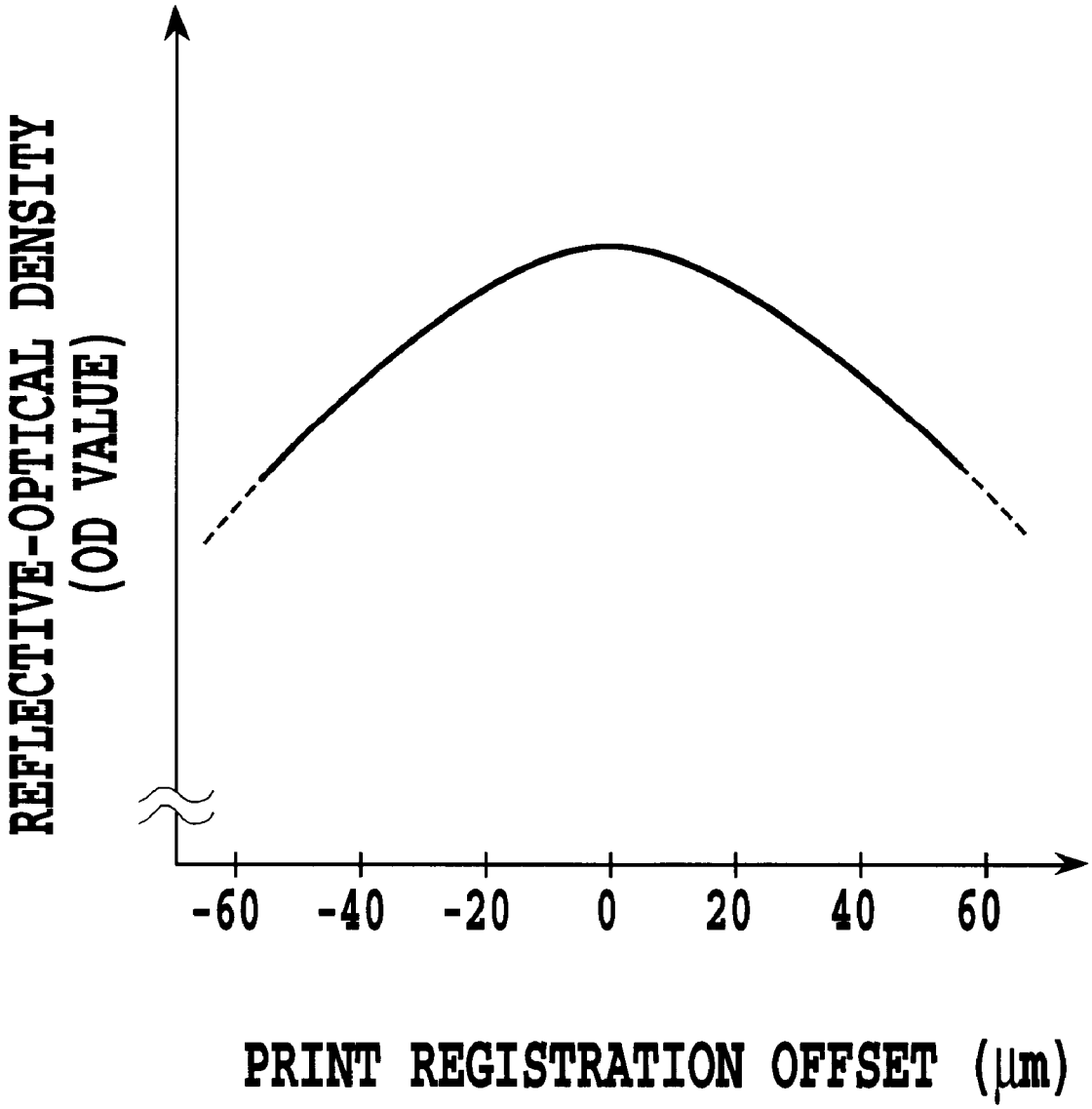
FIG. 9 is a graph illustrating the relationship between a printing position offset amount and a reflection optical density in the printing patterns in an embodiment according to the present invention.

FIG. 9 is a graph schematically illustrating the relationship between an offset amount of the printing position and a reflection optical density in the printing patterns shown in FIGS. 7A to 7C and 8A to 8C in the present embodiment.

In FIG. 9, the vertical line represents a reflection optical density (OD value); and the horizontal line, a printing position offset amount ($\mu$m). Using the incident light Iin 35 and the reflection light Iref 37 shown in FIG. 4, a reflection index R=Iref/Iin and a transmission index T=1−R.

Assuming that d represents a reflection optical density, $R=10^{-d}$. When the amount of printing position offset is zero, the area factor becomes 100%, and therefore, the reflection index R becomes minimum, i.e., the reflection optical density d becomes maximum. The reflection optical density d decreases as the printing position offsets relatively to any of the plus and minus directions.

4. Printing Registration Processing

Figure 10:
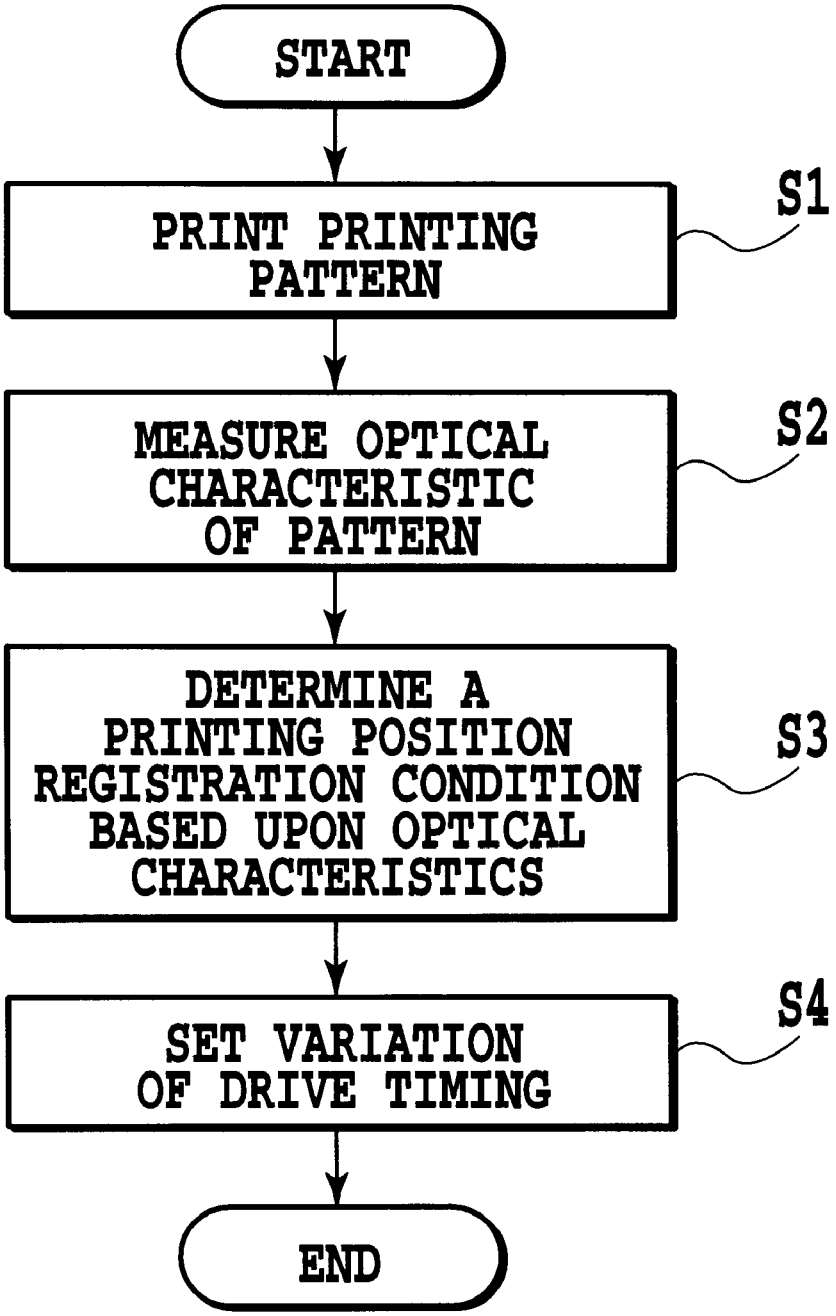
FIG. 10 is a flowchart illustrating schematic processing in an embodiment according to the present invention.

FIG. 10 is a flowchart of printing registration processing.

Referring to FIG. 10, first of all, the printing patterns are printed (step S1). Next, the optical characteristics of the printing patterns are measured by the optical sensor 30 (step S2). An appropriate printing registration condition is determined based on the optical characteristics obtained from the measured data (step S3). As graphically shown in FIG. 12 (described later), the point of the highest reflection optical density is found, two straight lines respectively extending through both sides of data of the point of the highest reflection optical density are found by the method of least squares, and then, the intersection point P of these lines is found. Like the above approximation using straight lines, approximation using a curved line may be used. Variations of drive timing are set based on the printing position parameter with respect to the point P (step S4).

Figure 11:
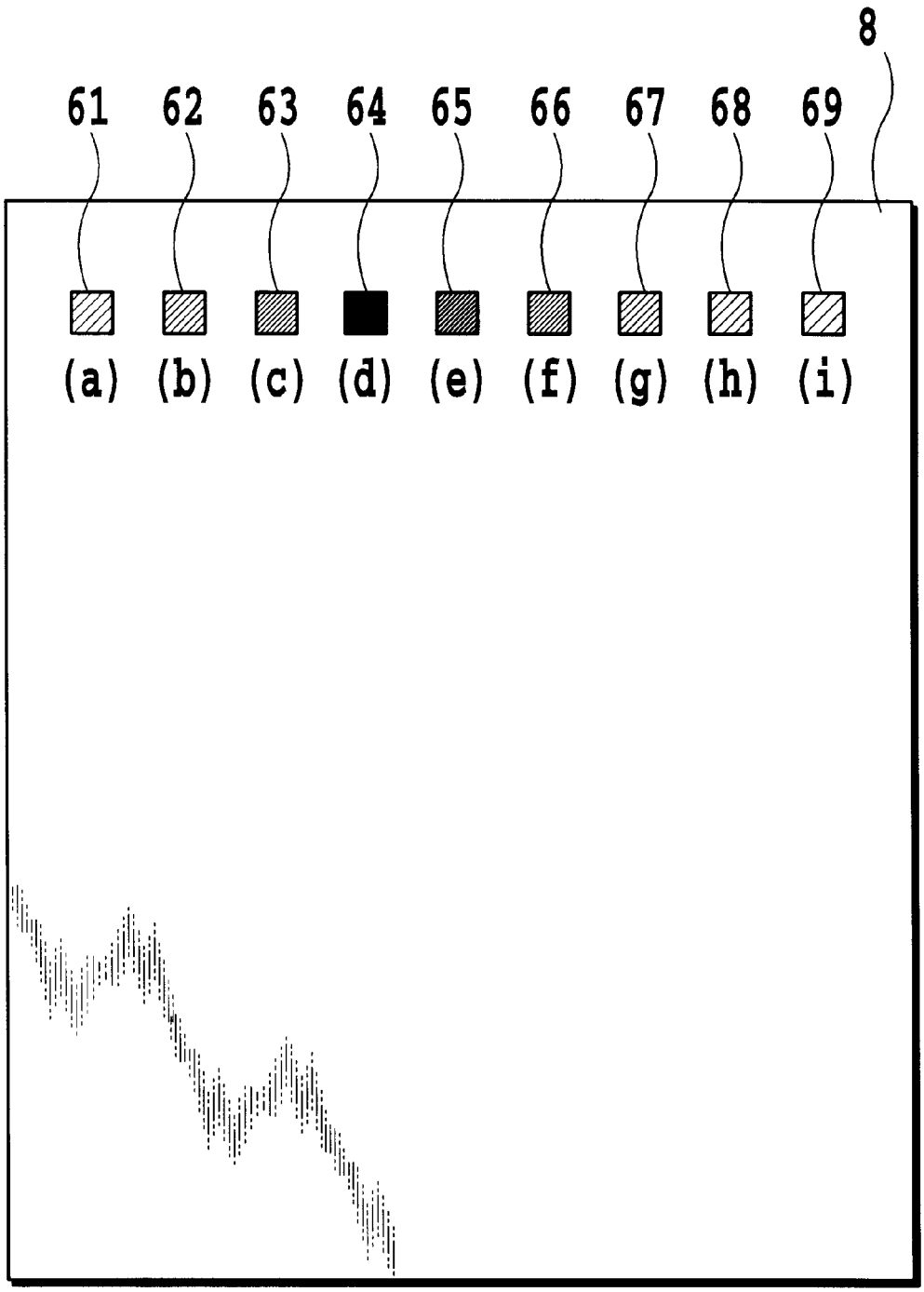
FIG. 11 is a schematic view illustrating the state in which the printing pattern is printed on a printing medium in an embodiment according to the present invention.

FIG. 11 is an illustration showing the state in which the printing patterns as shown in FIGS. 8A to 8C are printed on the printing medium 8. In the present embodiment, nine patterns 61 to 69 different in relative position offset amount between the dots printed in the forward scan and the reverse scan are printed. Each of the printed patterns is also called a patch, for example, a patch 61, a patch 62 and so on. Printing position parameters corresponding to the patches 61 to 69 are designated by (a) to (i). The nine patterns 61 to 69 may be formed by fixing the printing start timing in the forward scan and setting the nine printing start timings in the reverse scan, i.e., a currently set timing, four timings earlier than the currently set timing and four timings later than the currently set timing. The setting of the printing start timings and printing of the nine patterns 61 to 69 on the basis of the setting can be processed by a program started by a predetermined input command.

Then, the printing medium 8 and the carriage 2 are moved such that the optical sensor 30 mounted on the carriage 2 may be placed at positions corresponding to the patches 61–69 as the printed patterns thus printed. In the state in which the carriage 2 is stopped, the optical characteristics are measured. In this way, since the optical characteristics are measured in the state in which the carriage 2 is stopped, the influence of noise caused by the driving of the carriage 2 can be avoided. A distance between the sensor 30 and the printing medium 8 is increased to widen a measurement spot of the optical sensor 30 more than the dot diameter, thereby averaging variations in local optical characteristics (for example, the reflection optical density) on the printed pattern so as to achieve highly precise measurement of the reflection optical density of the patch 61 etc.

In order to relatively widen the measurement spot of the optical sensor 30, it is desired that a sensor having a resolution lower than a printing resolution of the pattern, namely, a sensor having a measurement spot diameter greater than the dot diameter, be used. Furthermore, from the viewpoint of determination of an average density, it is also possible to scan a plurality of points on the patch by means of a sensor having a relatively high resolution, i.e., a small measurement spot diameter and to take an average of the thus measured densities as the measured density. In order to avoid any influence of fluctuations in measurement, it may be possible to measure the reflection optical density of the same patch a plurality of times and to take an average value of the measured densities as the measured density.

Furthermore, in the embodiments of the present invention, since the optical sensor 30 is also used as other sensors such as that of a PE sensor, it is reasonable to use an optical sensor with the minimum required spot diameter for detecting the edge of the printing medium from the viewpoint of securing the accuracy for detecting the edge. Normally, one with a spot diameter between 0.5 mm and 3 mm is sufficient.

In order to avoid any influence of fluctuations in measurement due to the density variations on the patch, it may be possible to measure a plurality of points on the patch to average or perform other operations on them. Measurement can be achieved while the carriage 2 is moved for time saving. In this case, in order to avoid any fluctuation in measurement due to electric noise caused by the driving of the motor, it is strongly desired to increase the times of samplings and average or perform other operations.

Figure 12:
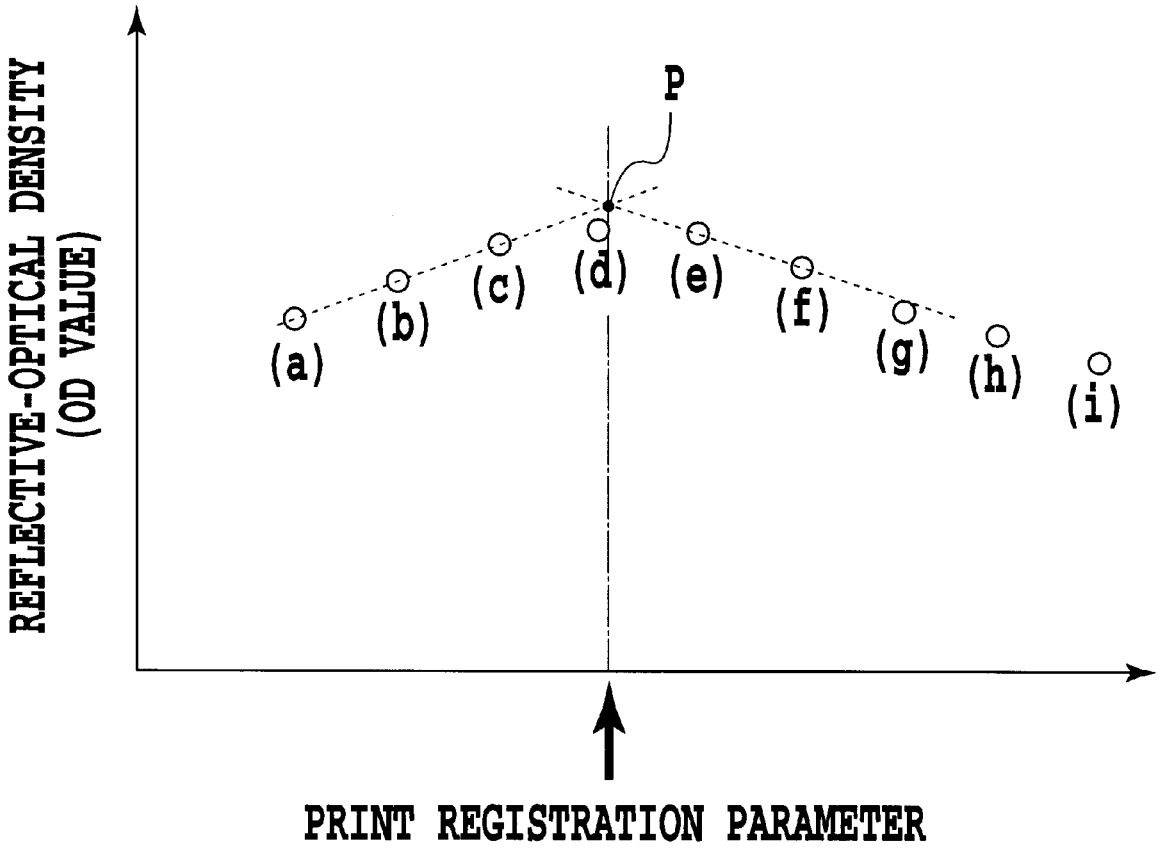
FIG. 12 is a graph illustrating a method for determining a printing registration condition in an embodiment according to the present invention.

FIG. 12 is a graph schematically illustrating an example of data of the measured reflection optical densities.

In FIG. 12, the vertical line represents a reflection optical density; and the horizontal line represents a parameter for varying the relative printing positions in the forward scan and the reverse scan. The parameter is adapted to advance or retard the printing start timing of the reverse scan with respect to the fixed printing start timing of the forward scan.

When measurement results shown in FIG. 12 are obtained in the present embodiment, the intersection point P of the two straight lines respectively extending through two points (the points respectively corresponding to printing position parameters (b), (c) and (e), (f) of FIG. 12) on both sides of the point where the reflection optical density is highest (the point corresponding to a printing position parameter (d) in FIG. 12) is taken as the printing position where the best printing registration is attained. In the present embodiment, the corresponding printing start timing of the reverse scan is set based on the printing position parameter corresponding to this point P. But, when strict printing registration is neither desired nor needed, the printing position parameter (d) may be used.

As graphically shown in FIG. 12, by this method, the printing registration conditions can be selected at a pitch smaller or a resolution higher than those of the printing registration conditions used for printing the printing pattern 61, etc.

In FIG. 12, the density is not varied significantly irrespective of the variations of the printing condition between the points where the density is high corresponding to printing position parameters (c), (d) and (e). To the contrary, between the points corresponding to printing position parameters (a), (b) and (c) or (f), (g), (h) and (i), the density is varied sensitively relative to the variations of the printing registration condition. When the characteristics of the density close to symmetry as in the present embodiment are exhibited, printing registration can be achieved with higher precision by determining the printing registration condition with the points indicating the variations of the density sensitive to the printing registration condition.

A method according to the present invention for determining the printing registration condition is not limited to the foregoing method. It may be intended that numerical calculation is performed with continuous values on the basis of a plurality of multi-value density data and information of the printing registration condition for use in the pattern printing, and then, the printing registration condition is determined with precision higher than a discrete value of the printing registration condition for use in the pattern printing.

For example, as an example other than linear approximation shown in FIG. 12, a polynomial approximate expression in which the method of least squares with respect to a plurality of printing registration conditions is obtained by using the density data for printing. The condition for attaining the best printing registration may be determined by using the obtained expression. It is possible to use not only the polynomial approximation but also spline interpolation.

Even when a final printing registration condition is selected from the plurality of printing registration conditions used for the pattern printing, printing registration can be established with higher precision with respect to fluctuations of various data by determining the printing registration condition through numerical calculation using the above-described plurality of multi-value data. For example, in a method for selecting the point of the highest density from the data of FIG. 12, it is possible that the density at the point corresponding to the printing position parameter (d) is higher than that of the point corresponding to the printing position parameter (e) due to the fluctuations. Therefore, in a method for obtaining an approximate line from three points on each of both sides of the highest density point to calculate an intersection point, the influence of fluctuation can be reduced by performing calculation using data of more than two points.

In the foregoing, an explanation was made on the assumption that dot forming registration adjustment is performed in a forward printing and a reverse printing (which correspond to a first printing and a second printing, respectively), which constitute a bi-directional printing operation. The explanation is also applicable to the case where printing registration is performed in respective printing operations by a plurality (two) of printing heads 1. This printing registration may be performed, instead of or in addition to, the above.

The above explanation is also applicable to the case where printing registration is performed in respective printing operations by a plurality (two) of printing heads 1 in the direction perpendicular to the carriage scanning direction. In this case, in order to perform correction of a printing position in the direction perpendicular to the carriage scanning direction (sub scanning direction), ink ejecting openings of the printing head are provided over a range wider than a width (band width) in the sub scanning direction of an image formed by one scan so as to permit correction of the printing position at each interval between the ejection openings by shifting the range of the ejection openings to be used. Namely, as a result of shifted correspondence between the data (image data or the like) to be output and the ink ejection openings, it becomes possible to shift the output data per se.

An execution range of the dot alignment can be defined as required corresponding to the printing modes, the construction or the like of the apparatus. For example, in the printing apparatus using a plurality of printing heads, the dot alignments between bi-directional printing and between printing by the plurality of heads are carried out, and in the printing apparatus using only one head, the dot alignment of bi-directional printing has only to be carried out. Moreover, even in the case of one head, when it is possible to eject the ink of a different color tone (a color and/or a density) or when the different amount of ejection can be obtained, for each color tone or each amount of ejection, the dot alignment may be carried out.

5. Sensor Operating Modes of Optical Sensor

Even in the case of sensors of the same construction manufactured to the same specifications, it is often the case as a matter of fact that the characteristics vary from sensor to sensor. Furthermore, the reflection characteristics differ greatly depending on the individual recording medium. Taking these factors into consideration, and moreover taking into account the fact that the optical sensor 30 is intended to cope with cases where the output of the sensor is used similarly to the on/off status of a switch, namely with cases where the output is used for determining whether the status is "0" or "1," as well as with cases where the sensor is activated in regions of good linearity so that linear output can be obtained in response to input, it is desirable, even in the case of sensors of the same construction manufactured to the same specifications, to use such a sensor by appropriate switching control methods.

Figure 13:
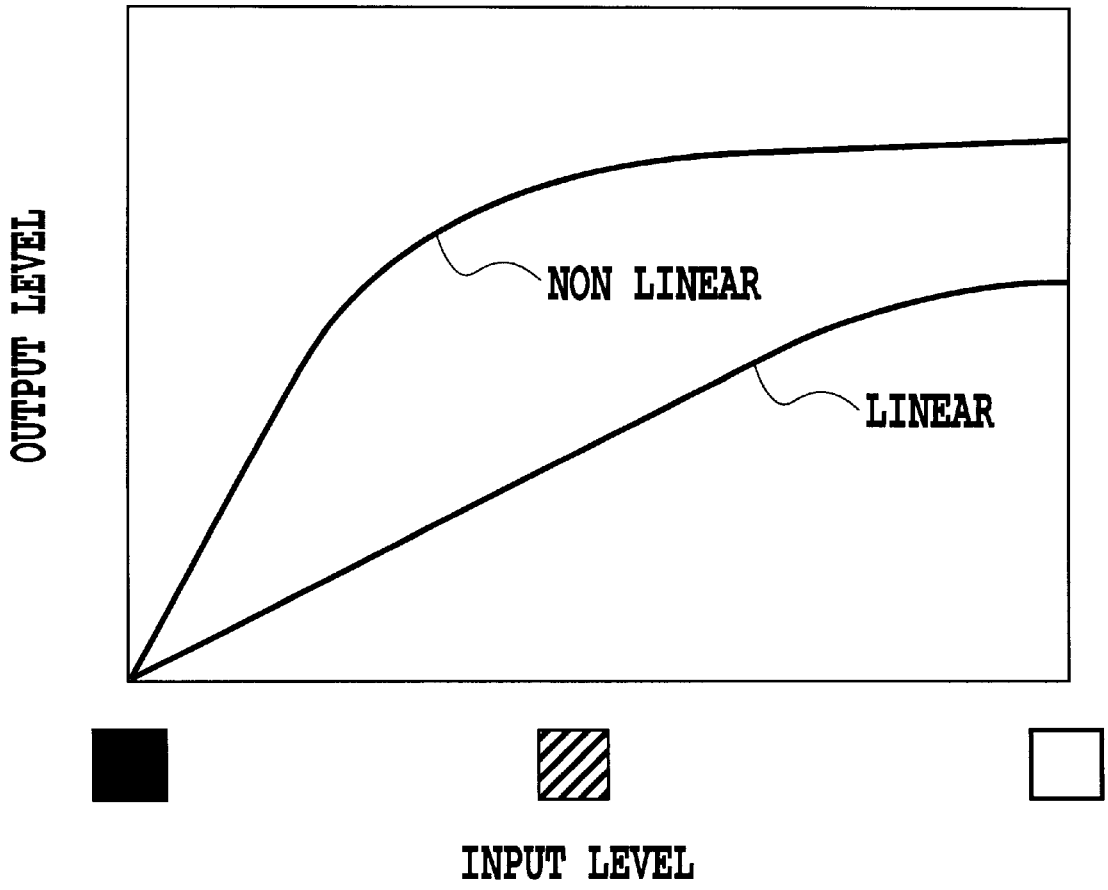
FIG. 13 shows a difference in sensitivity curves corresponding to control methods for an optical sensor.

The above is explained by using FIG. 13. When an optical sensor is used similarly to a switch, importance is set not on securing linearity on output to input but rather on ensuring that the on/off status is clearly exhibited by increasing the S/N ratio. Therefore, it is important that the optical sensor is controlled such that a region where nonlinear output characteristics appear in response to input, namely a domain where the output level is saturated, is also used. In contrast to the above, in cases where densities of a plurality of printing patterns are read by means of the optical sensor for use in treatment such as the registration processing, it is extremely desirable to perform activation with importance attached to linearity.

Figure 14:
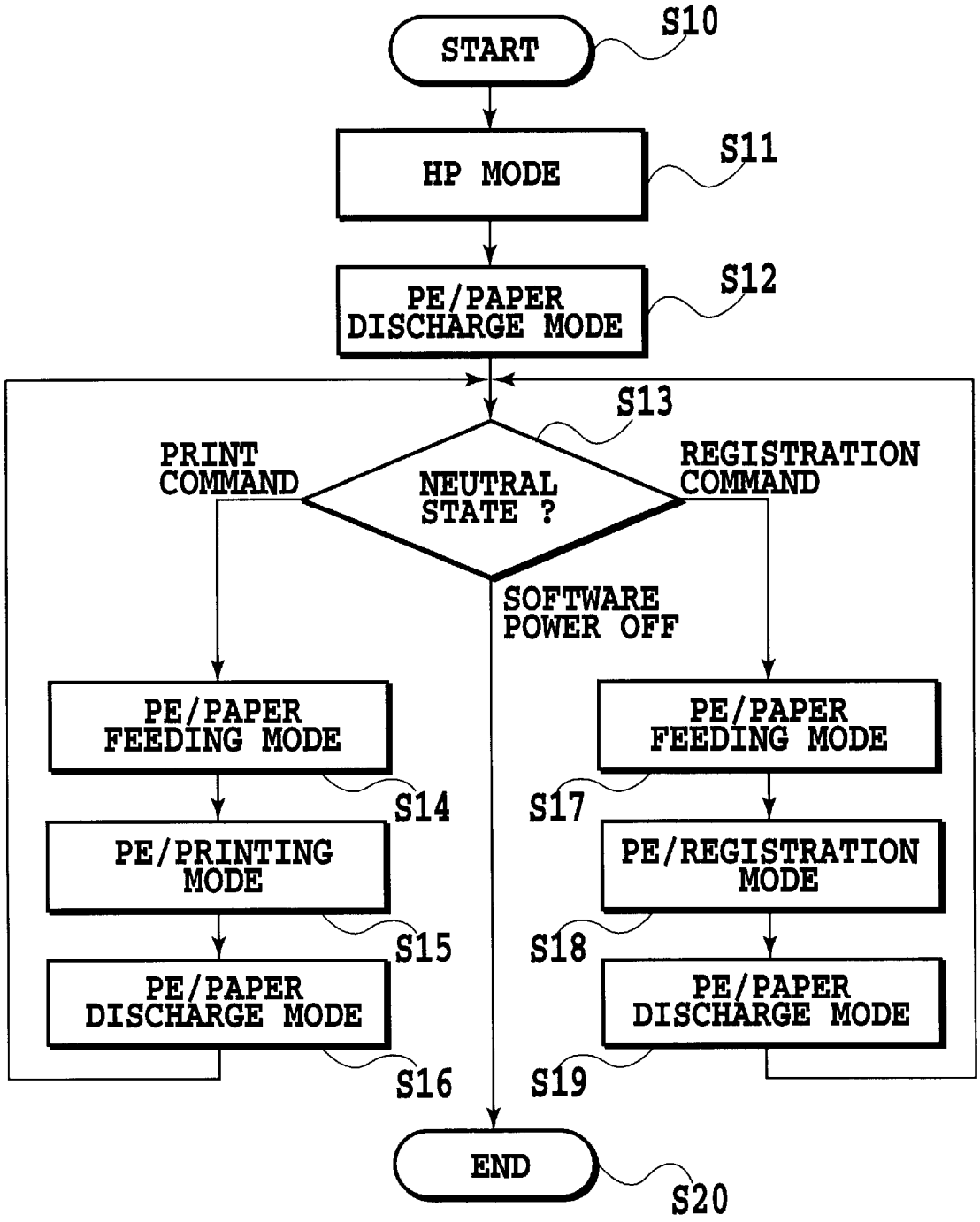
FIG. 14 is a flowchart showing the outline of processing procedures whereby an optical sensor in an ink jet printing apparatus relating to an embodiment of the present invention is used by switching modes.

FIG. 14 is a flowchart showing an example of control processing procedures focusing on the activation of the optical sensor 30 in the construction of the printing apparatus in FIGS. 1 and 5. When the operation of the printing apparatus is initiated, this procedure is started in step S10, and then the optical sensor control is set, in step S11, to the home position detection mode (hereinafter referred to as a HP mode).

Figure 15:
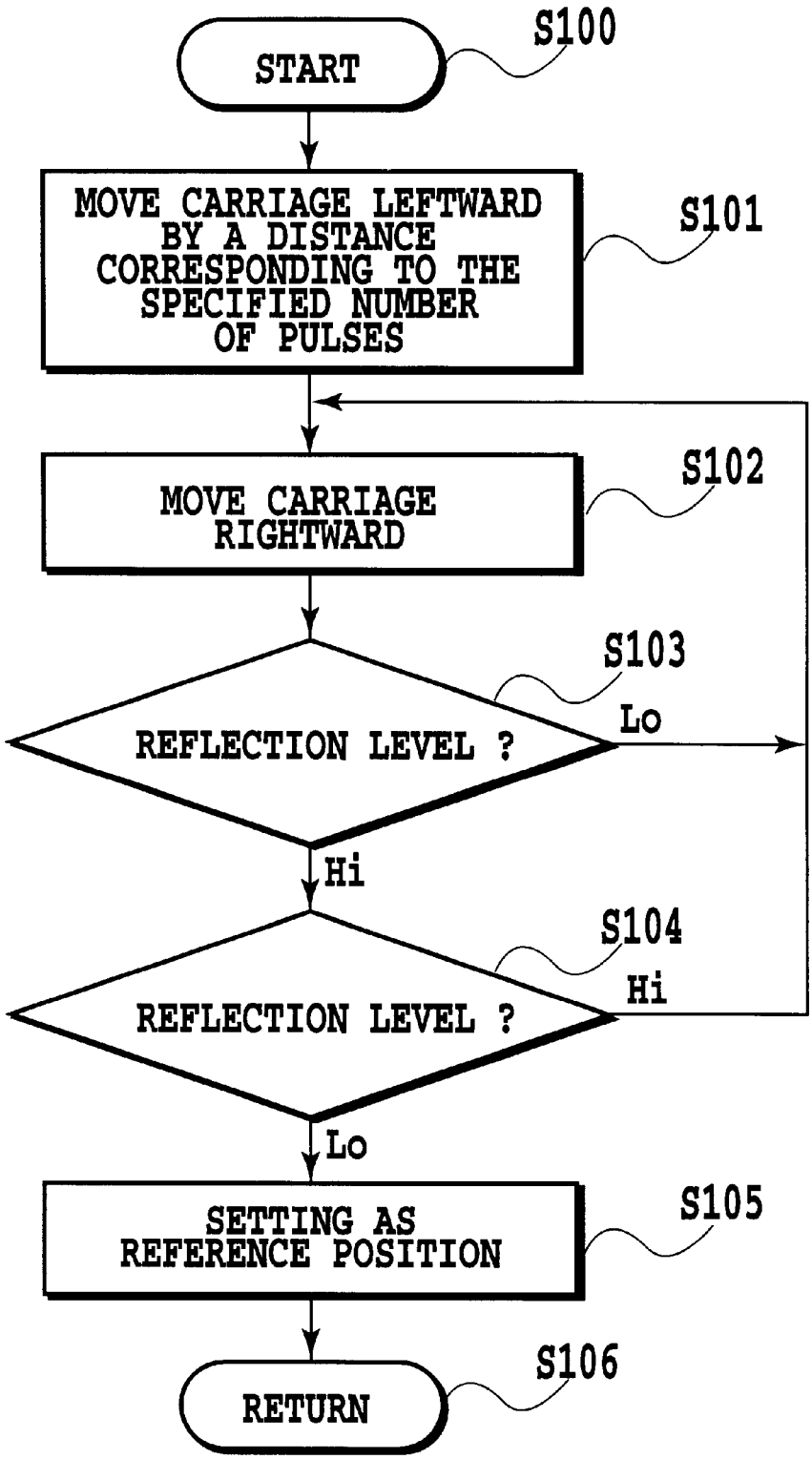
FIG. 15 is a flowchart showing an example of processing procedures corresponding to the mode for searching the home position of the modes used for an optical sensor in an embodiment of the present invention.

FIG. 15 is a flowchart showing an example of control processing procedures in the HP mode. When the processing procedure in this mode is started in step S100 according to the setting done instep S11 in FIG. 14, the main scanning motor 152 is driven, in step S101, for the predetermined number of pulses, thereby moving the carriage 2 leftward in FIG. 1 by the corresponding distance. Next, in step S102, the carriage 2 is moved rightward in the similar manner. During this process, the optical sensor 30 is driven in step S103, and the reflected density level is checked on the basis of the resulting output. In this embodiment, a marking is located in the neighborhood of that predetermined place on the apparatus corresponding to the home position of the carriage 2 or of the printing head 1, and thus the home position can be detected by checking the reflection level during the process of the rightward movement.

Figure 16A:
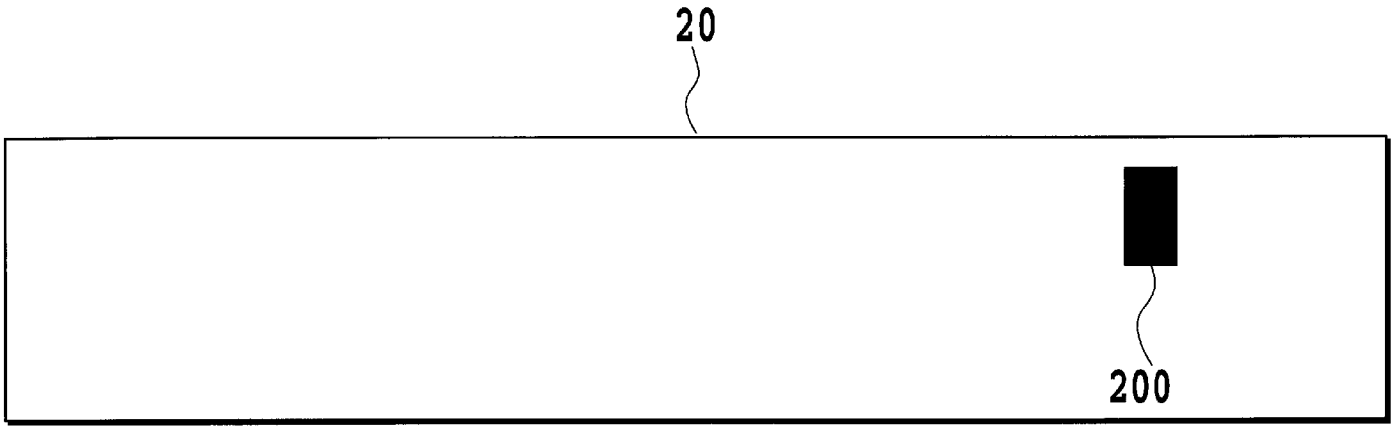
FIGS. 16A and 16B illustrate printing patterns usable in the processing shown in FIG. 14.
Figure 16B:
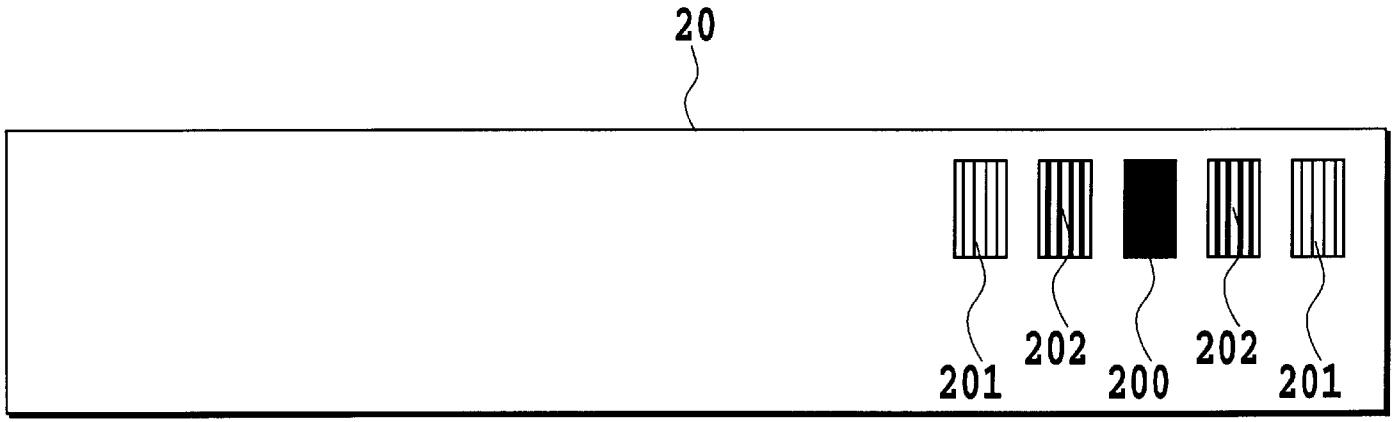

FIGS. 16A and 16B show two examples of markings for detecting the home positions. The markings are provided on the platen 20 located within the main scanning limits of the printing head 1 to constrain the printed surface of the printing medium to be flat.

FIG. 16A shows an embodiment whereby a pattern 200 having stronger lightness or contrariwise dimmer lightness than the platen 20 is formed on the platen 20. Moreover, FIG. 16B shows an embodiment whereby patterns 200, 201, and 202, which are similar to the pattern used for registration purposes as mentioned above, are formed on the platen 20 such that the detection of the home position and the setting of the carriage 2 to the home position are performed with higher precision. In the case of either embodiment, any of the patterns are formed on the area of the platen 20 through which the optical sensor 30 passes so that reading will be carried out during the process where the carriage 2 performs rightward scanning in step S102. Patterns such as 200 through 202 can be formed by previously subjecting the platen 20 to processing such as printing treatment, surface treatment, roughening or embossing, and drilling. Besides, patterns can be provided in appropriate forms if a construction is adopted such that no trouble is caused to operations such as the conveyance of the printing medium, the main scanning of the printing head, or the constraint of the printed surface of the printing medium or the like during printing. For example, a sticker with required patterns printed may be attached 5 to the platen 20.

When the patterns shown in FIG. 16B are used, it is extremely desirable to perform control such that the reading characteristics of the optical sensor 30 have a satisfactory linearity. On the other hand, when the pattern shown in FIG. 16A is used, it is extremely desirable to perform control such that the on/off status appears clearly. In what follows, an explanation is made on the assumption that the pattern 200 (a pattern having a dimmer lightness than platen 20) is provided on the platen 20.

Figure 17:
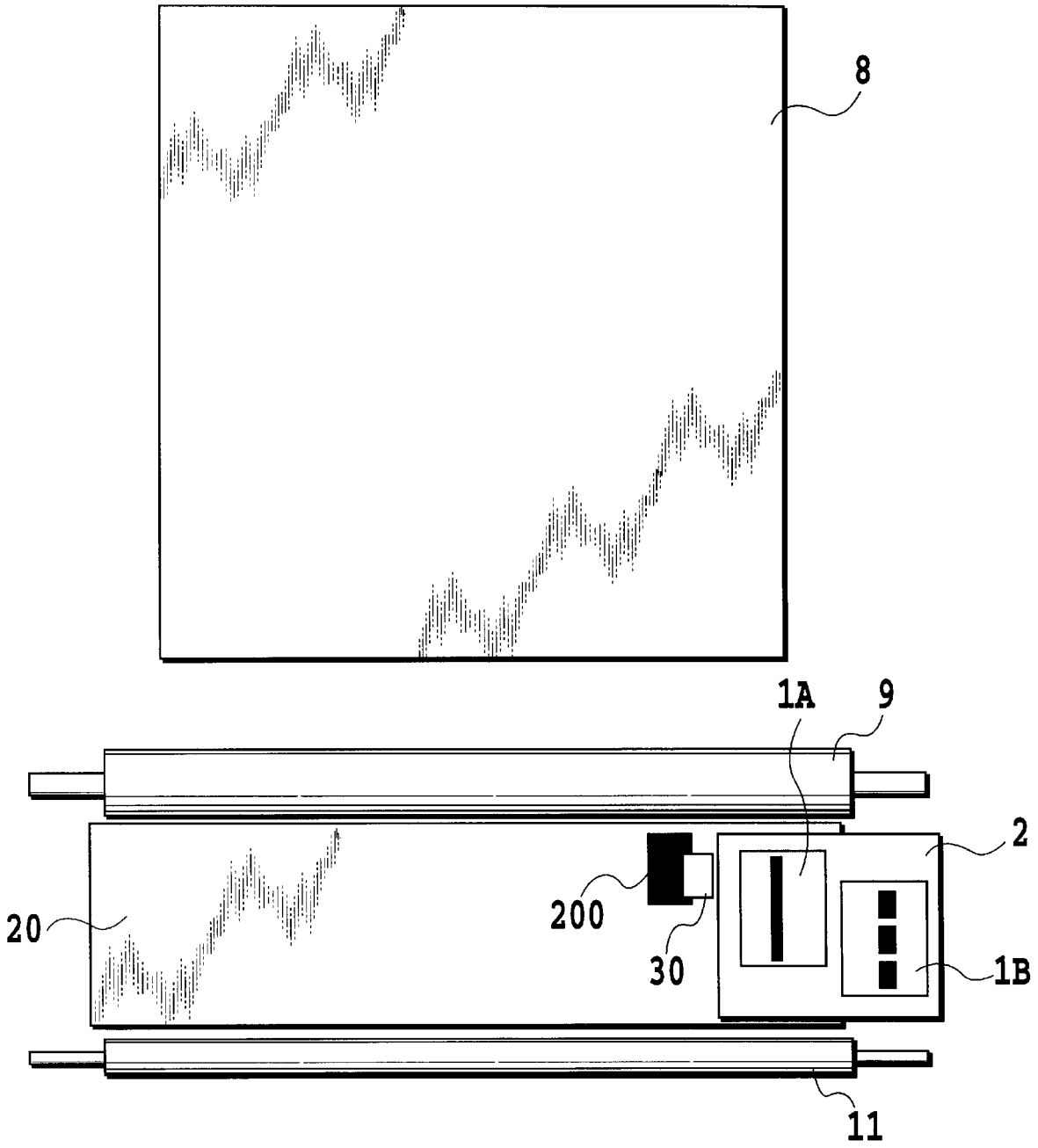
FIG. 17 is a schematic drawing for explaining the relative positional relationship between an optical sensor and a marking formed on a platen to search the home position by means of an optical sensor.

FIG. 17 is a schematic plan view of the entire apparatus in this embodiment, and shows the relative positional relationship between the optical sensor 30 and the marking (pattern 200) formed on the platen to search the home position by means of the optical sensor. In the resulting HP mode, the drive conditions are appropriately set such that the characteristics of the optical sensor 30 extend over the portion of FIG. 13 indicating the saturation curve, thereby controlling the optical sensor 30.

FIG. 15 is referred to again. The pattern 200 is scanned by the optical sensor 30 which is subjected to drive control as mentioned above, and after a rise in the reflection density level is detected in step S103, a fall in the reflection density level is detected, contrarily, in step S104. Next, an intermediate position is determined between the level rising and the level falling conditions, and the intermediate position is set as the reference position, then the operation returns in step S106 to the processing procedure in FIG. 14.

In specific terms, in the case of this embodiment, this reference position serves as the reference point for the rotational position control of the main scanning motor 152 in the form of a pulse motor. In order to determine the home position of the carriage 2 on the basis of this reference position, depending on the relative positional relationship between the optical sensor 30 and the printing head 1, the relationship between the home position and the carriage 2 may be established, for example, such that the carriage 2 reaches the home position when the main scanning motor 152 is driven from the reference position for the specified number of pulses to move the carriage 2 rightward. Moreover, depending on factors such as the position of the optical sensor 30, the home position detecting pattern may be provided at a position outside the width of the printing medium used. In this case, the carriage position need not be controlled by means of the number of drive pulses of the pulse motor, and it also becomes possible to use a DC motor or the like as the main scanning motor.

Next, in step S12 in FIG. 14, the control of the optical sensor is set to the mode for mainly detecting the printing medium rear end (paper end) for the purpose of performing the ejection of the printing medium (paper discharge). This mode is referred to as a "PE/ paper discharge mode", hereinafter.

Figure 18:
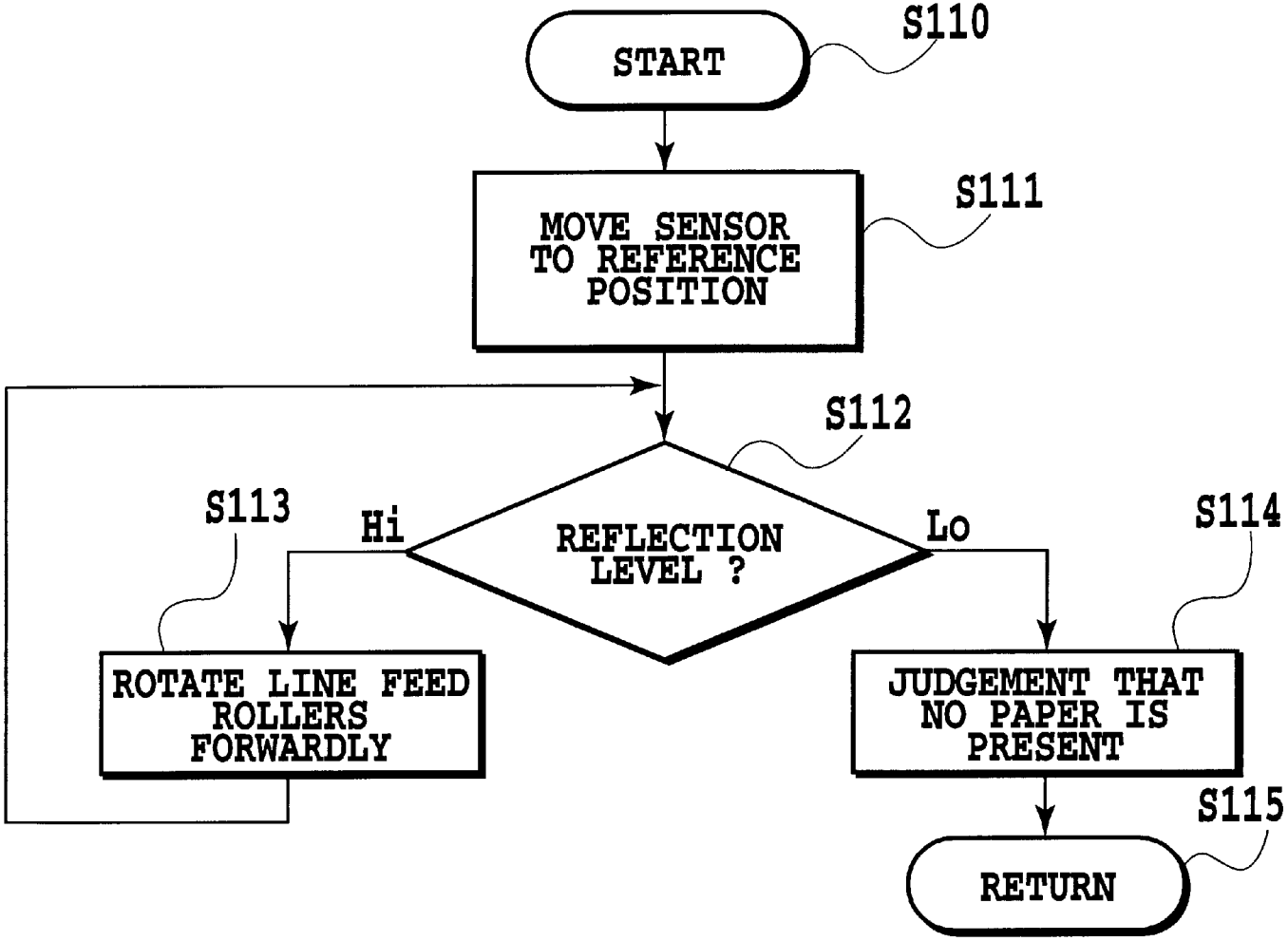
FIG. 18 is a flowchart showing an example of processing procedures corresponding to the mode for using the optical sensor as the paper end sensor during ejection of the printing medium of the modes used for an optical sensor in an embodiment of the present invention.

FIG. 18 is a flowchart showing an example of processing procedures in the PE/ paper discharge mode. After the processing procedure in this mode is started according to the setting in step S12 in FIG. 14, the carriage 2 is controlled in step S111 and moved to a reference position where the optical sensor 30 can detect the passage of the printing medium. Next, the reflection level is checked in step S112. In this mode, the existence or nonexistence of the printing medium is judged by the binary "1" or "1," and the drive conditions are set appropriately such that the characteristics of the optical sensor 30 extend over the portion of FIG. 13 which indicates the saturation curve, thereby controlling the optical sensor 30.

In this judgment processing, if the reflection level is "high," it is assumed that the printing medium is present, and the line feed (LF) rollers 9 and 11 are forwardly rotated in step S113, thereby discharging the printing medium remaining on the conveyance path. On the other hand, if it is verified in step S112 that the reflection level has fallen to "low," it is determined in step S112 that the printing medium is not present, and the operation returns in step S115 to the procedure in FIG. 14.

In FIG. 14, the neutral state is reached in step S13. This state is a neutral state which persists until the next command arrives. This state is divided roughly into three cases. One is the case where the print command for executing printing is to be received, another is the case where the command for executing printing registration is to be received, and still another is the case where the command for power cutoff is to be received.

When the print command is received, the process goes to step S14, and the control of the optical sensor is set to the mode for mainly detecting the printing medium front end for the purpose of feeding the printing medium. This mode is referred to as a "PE/ paper feeding mode", hereinafter.

Figure 19:
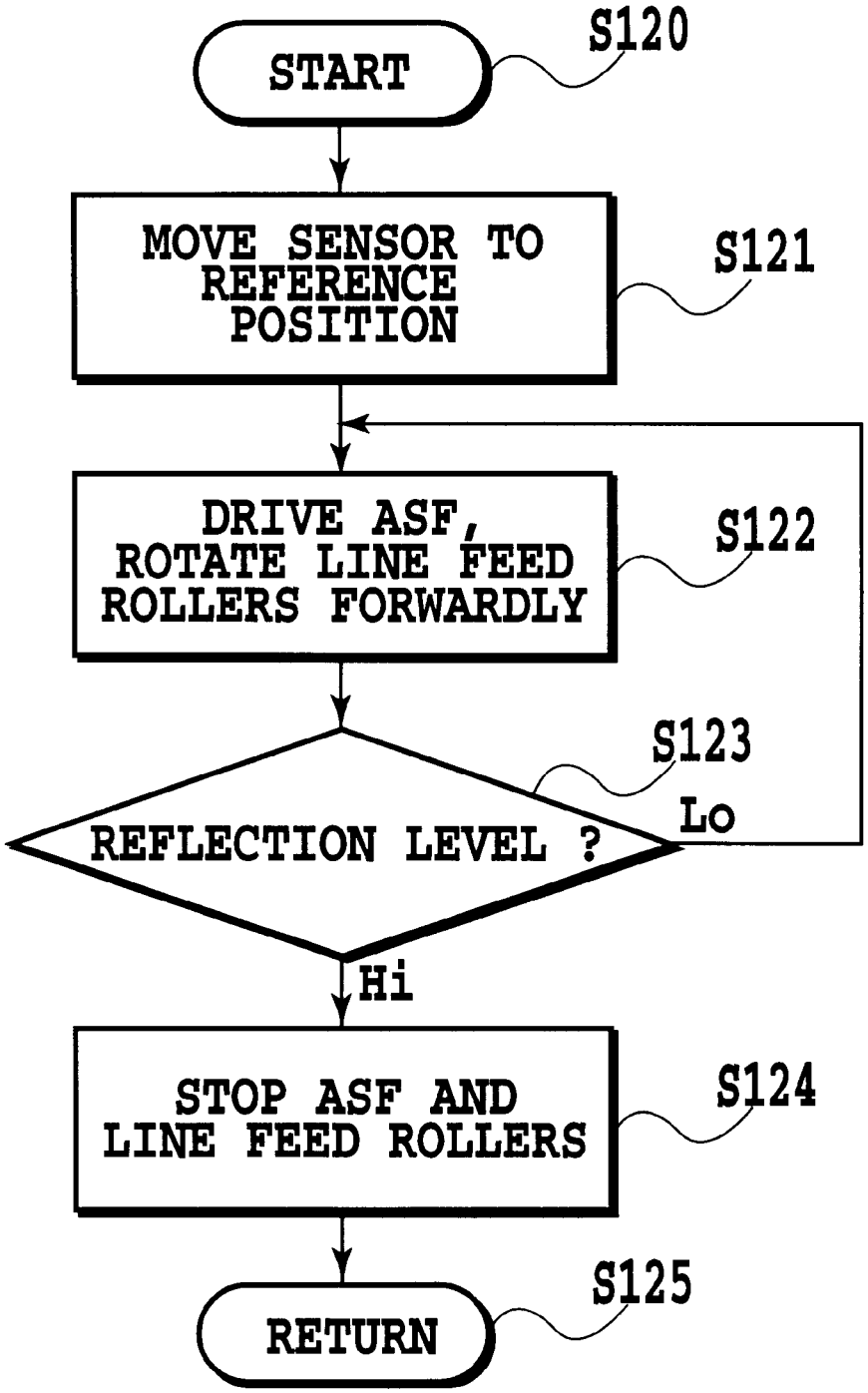
FIG. 19 is a flowchart showing an example of processing procedures corresponding to the mode for using the optical sensor as the paper end sensor during feeding of the printing medium of the modes used for an optical sensor in an embodiment of the present invention.
Figure 20:
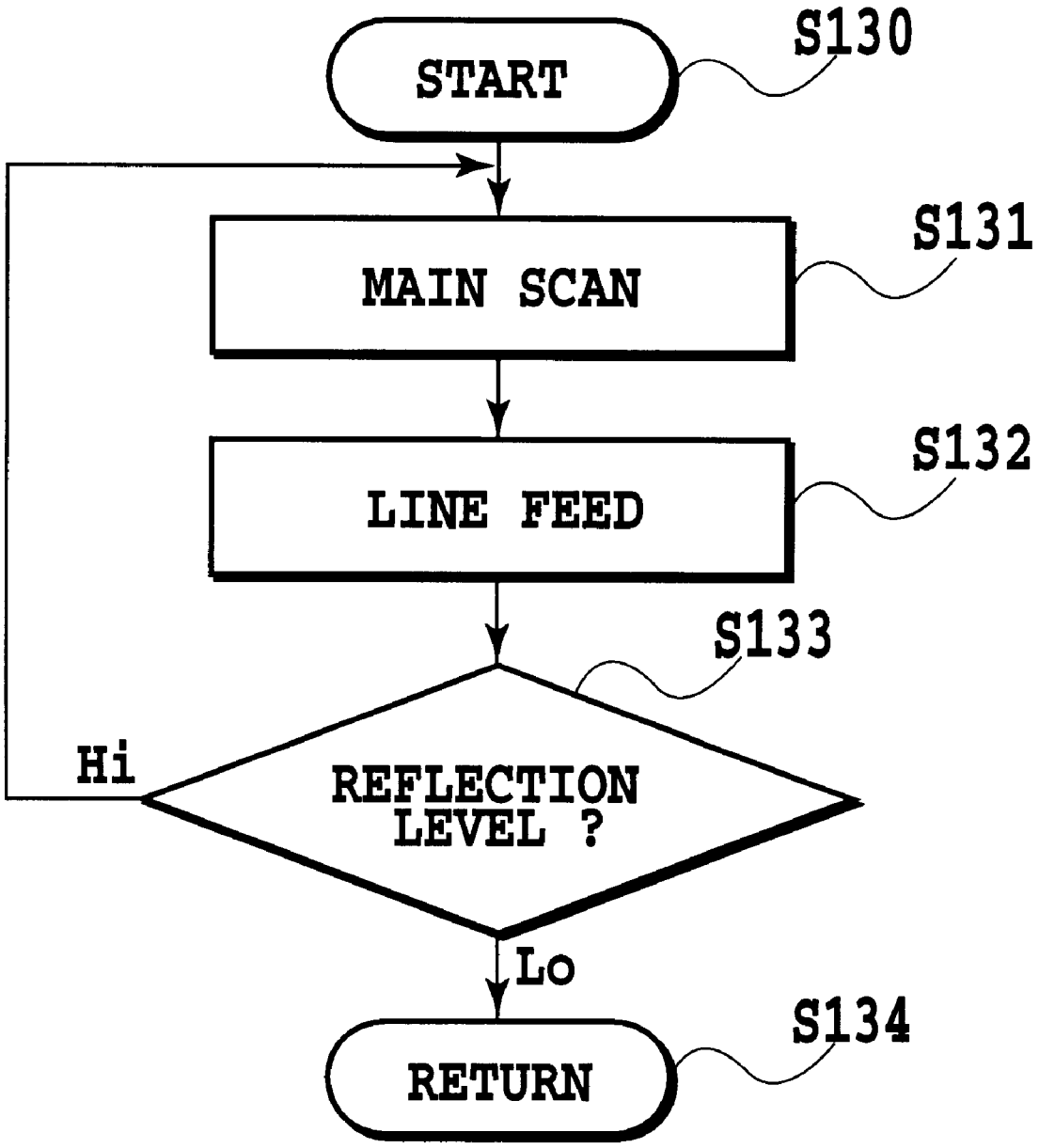
FIG. 20 is a flowchart showing an example of processing procedures corresponding to the mode for using the optical sensor as the paper end sensor during printing operation of the modes used for an optical sensor in an embodiment of the present invention.

FIG. 19 is a flowchart showing an example of processing procedures in the PE paper feeding mode. After the processing procedure in this mode is started in step S120 according to the setting in step S14 in FIG. 14, the carriage 2 is first controlled in step S121 and moved to the reference position area where the optical sensor 30 can detect the passage of the printing medium. Next, the printing medium feeding means such as an automatic sheet feeder (ASF; not shown) is driven in step S122 and also the LF roller 9 is forwardly rotated to feed the printing medium. Then, the reflection level is checked in step S123. In this mode, the existence or nonexistence of the printing medium is judged by the binary "0" or "1," and the drive conditions are set appropriately such that the characteristics of the optical sensor 30 extend over the portion of FIG. 13 which indicates the saturation curve, thereby controlling the optical sensor 30.

In this judgment processing, if the reflection level is "high," it is assumed that the printing medium is present, and the forward rotation of the LF roller is stopped in step S124. At this point, the setting of the printing medium on the conveyance path is completed, and therefore the operation returns in step S125 to the processing procedure in FIG. 14.

Next, in step S15 in FIG. 14, the control of the optical sensor is set to the mode for mainly detecting the printing medium rear end (hereinafter referred to as PE/ printing mode).

FIG. 19 is a flowchart showing an example of processing procedures in the PE/ printing mode. After the processing procedure in this mode is started in step S130 according to the setting in step S15 in FIG. 14, main scanning of the carriage 2 is first performed in step S130, and line feeding is performed in the specified amount. Next, the reflection level is checked in step S132 to determine if the portion being checked is the rear end of the printing medium. In this mode, the existence or nonexistence of the printing medium is judged by the binary "0" or "1," and the drive conditions are set appropriately such that the characteristics of the optical sensor 30 extend over the portion of FIG. 13 which indicates the saturation curve, thereby controlling the optical sensor 30.

In this judgment processing, if the reflection level is "high," it is assumed that the recording medium is present, and the operation returns to step S131 to continue printing; if the reflection level is "low," this mode is completed, and the operation returns in step S131 to the processing procedure in FIG. 14. Then the operation proceeds in step S16 to the PE/ paper discharge mode, and after completion of the paper discharging, the operation is switched to the neutral state, and if any more data to be printed is present, the operation proceeds further to step S14.

If the print registration command is received in the neutral state, the operation goes into the registration mode. Namely, the system is set to the PE/ paper feeding mode, in step S17, and to the mode for detecting the printing medium rear end during registration processing (PE/ registration mode), in step 18. The registration operation in this mode is as mentioned above in FIGS. 7 through 12, and the optical sensor 30 in this mode is so set as to be driven in a region of satisfactory linearity.

After completion of registration operation, the system is set, in step S19, to the PE/ paper discharge mode so that the printing medium, for instance, the printing medium on which patterns as shown in FIG. 11 are formed, will be discharged. When operation is completed after the printing medium is discharged, the system returns to the neutral state.

After the command for a software power cutoff is received in the neutral state, operation proceeds to step S20 to complete the control operation for the sensor 30.

As explained above, by using the embodiment apparatus, each of a plurality of detection functions which are not executed simultaneously can be served by using a single sensor with switching operating modes thereof, furthermore, in this application, conditions for controlling sensor functions can be appropriately switched according to the intended use, thus making it possible to obtain an effect beyond a cost reduction by merely simplifying the construction of a printing apparatus.

Besides, a switching of the control of the optical sensor 30 can be performed as follows.

Figure 21:
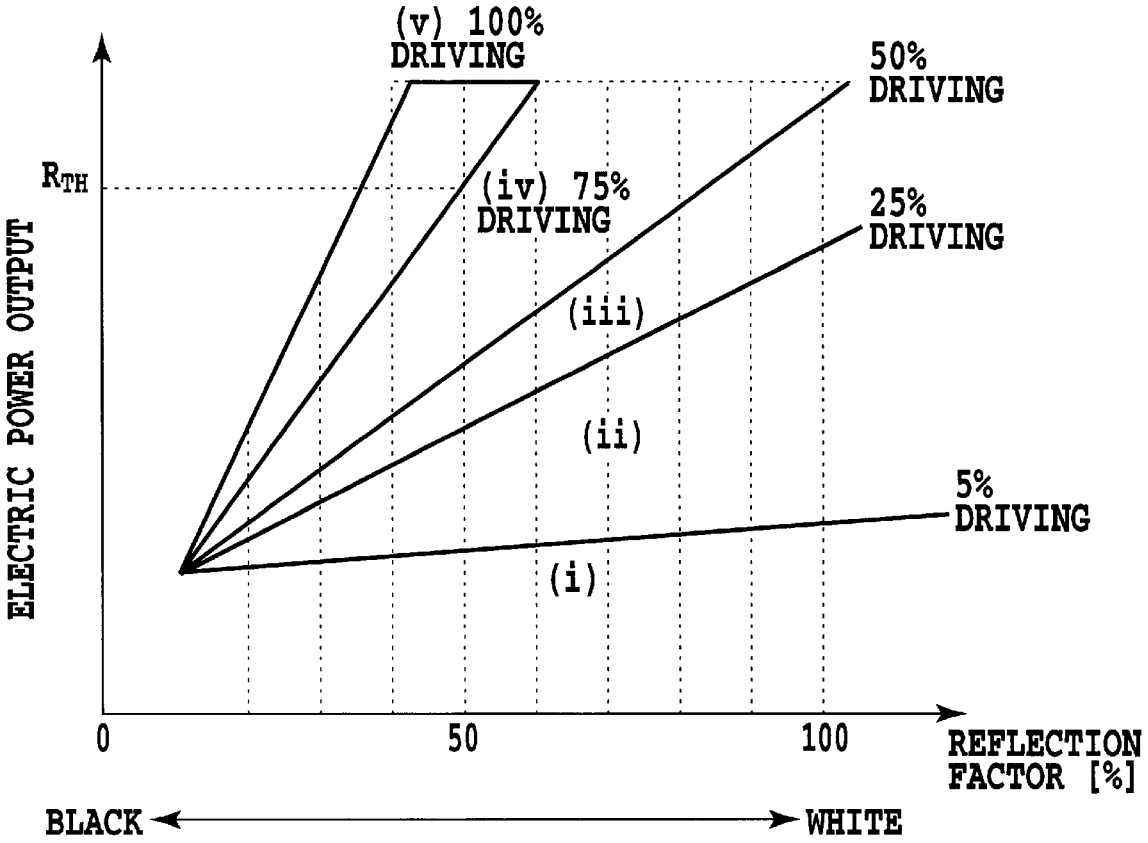
FIG. 21 is an explanatory chart for explaining how control is performed when an optical sensor in an embodiment of the present invention is used by switching characteristics thereof.

Reflection densities (output) of measurement objects having different reflection factors (for example, patterns formed to have reflection factors between 0% and 100% in increments of 10%) are measured by varying electrical signals supplied to the light emitting portion 31 of the optical sensor 30, and FIG. 21 shows the results of the measurement. In this figure, abscissas represent reflection factors and ordinates represent reflection densities (output). If the change of the quantity of the reflected light from a predetermined pattern is smaller than the resolution of the light emitting portion 31 because the duty of the electrical signals applied on the light emitting portion is too small, the output change is slight as shown by characteristics (i) in FIG. 21. If the duty is too heavy, no change is observed in reflection density (output) itself at a point where the quantity of the reflected light exceeds the maximum detection width of the photosensing portion, as shown by characteristics (v) in FIG. 21.

Namely in a case where characteristics as shown in FIG. 21 are used to judge whether the state-indicating binary is "0" or "1" (when the printing medium end is to be detected or when a pattern such as the one in FIG. 16A is to be detected), the quantity of light at the light emitting portion may be changed (and/or the sensitivity of the photosensing portion 32 may be changed), for example, by selecting the drive duty of the light emitting portion 31 (and/or the photosensing portion 32) such that characteristics (iv) or (v) are exhibited. Moreover, in a case where drive is performed in a region of good linearity so as to obtain linear output in response to input (when a pattern for printing registration or a pattern such as the one in FIG. 16B is measured), the quantity of light at the light emitting portion may be changed (and/or the sensitivity of the photosensing portion 32 may be changed), for example, by selecting the drive duty of the light emitting portion 31 (and/or the photosensing portion 32) such that characteristics (ii) or (iii) are exhibited. Besides, in the latter case, instead of the handling of situations where an output change takes place throughout the reflection factor region (0 to 100%), it is permissible to use the region in which an output change is sufficiently obtained according to the actually used reflection factor region for printing registration. In this context, the condition for the situation where the output change is sufficiently obtained is that an output change should be obtained when the printing position is shifted by a minimum distance with respect to the actual print registration pattern.

6. Others

In each of the above embodiments, an example of an ink jet printing apparatus in which the ink is ejected from its printing head on a printing medium to form an image has been shown. However, the present invention is not limited to this configuration. The present invention is also applicable to a printing apparatus of any type which performs printing by moving its printing head and a printing medium relatively and to form dots.

However, in the case that an ink jet printing method is applied, the present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof are disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated into the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through-holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

Additionally, in the above embodiments, the processing of printing registration is carried out in the side of the printing apparatus. The processing may be carried out in the side of a host computer 110 shown in FIG. 5 or the like, appropriately. That is, though a printer driver installed in the host computer 110 shown in FIG. 5 is designed to supply image data made to the printing apparatus, in addition to this, the printer driver may be designed to make test patterns (printing patterns) for printing registration and to supply them to the printing apparatus, and further designed to receive values read from the test patterns by an optical sensor on the printing apparatus for calculating adjustment amount.

As explained above, according to the present invention, the optical sensor for measuring the pattern formed for printing registration purposes can also be used in common for other purposes, such as detection of the printing home position or the printing medium end. Furthermore, by appropriately controlling a single optical sensor according to each intended use, it is possible to utilize the optimum characteristics in each operating mode. Because of the above, the addition of a sensor which is used solely for printing registration and whose frequency in use is not considered to be significantly great can be avoided, and the accompanying rise of the print apparatus production cost can likewise be avoided. Moreover, the complexity of the construction of peripheral equipment accompanying the increase of the number of sensors installed in the printing apparatus can be restrained, namely the increase of the number of amplification circuits, reference voltage circuits, and input ports can be restrained, thereby contributing to the reduction of the cost of a printing apparatus capable of performing printing registration.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A printing apparatus for performing printing on a printing medium by using a printing head, comprising:

means for controlling said printing head to form a plurality of patterns, said plurality of patterns being respectively formed corresponding to a plurality of shifting amounts of relative printing positions of a first printing and a second printing to be registered and said plurality of patterns respectively representing optical densities corresponding to said plurality of shifting amounts;

optical measuring means for measuring respective optical densities of said plurality of patterns in a measuring operation;

means for performing printing registration processing between said first printing and said second printing on the basis of the variation of said optical densities represented by said plurality of patterns measured by said optical measuring means;

means for performing a detecting operation distinct from the measurement of said optical densities in the measuring operation by using said optical measuring means; and means for switching controlling characteristics of said optical measuring means between the measuring operation and the detecting operation, respectively, by using a region where a characteristic of said optical measuring means is linear and a region where the characteristic of said optical measuring means is saturated.

2. A printing apparatus as claimed in claim 1, wherein said printing head is mounted on a carriage and scanned in a predetermined direction with respect to said printing medium, and said detecting means detects a predetermined position of said printing head in the predetermined direction by using said optical measuring means.

3. A printing apparatus as claimed in claim 2, wherein said detecting means detects said predetermined position by reading a predetermined pattern disposed on said apparatus.

4. A printing apparatus as claimed in claim 2, wherein said optical measuring means is mounted on said carriage.

5. A printing apparatus as claimed in claim 1, wherein said detecting means has means for detecting whether said printing medium is present.

6. A printing apparatus as claimed in claim 1, wherein said optical measuring means has a light emitting portion and a photosensing portion, and said switching means for controlling characteristics of said optical measuring means has at least one of adjusting means for changing the quantity of light at said light emitting portion and/or adjusting means for changing the sensitivity of said photosensing portion.

7. A printing apparatus as claimed in claim 1, wherein said first printing and said second printing include at least one among a printing in a forward scan and in a reverse scan respectively upon performing printing by bi-directionally scanning said printing head with respect to said printing medium, a printing being a printing by a first printing head and a printing by a second printing head among a plurality of said printing heads respectively in a direction in which said first printing head and said second printing head are relatively scanned with respect to said printing medium, and a printing being a printing by a first printing head and a printing by a second printing head among a plurality of printing heads respectively, in a direction different from the direction which said first printing head and said second printing head are relatively scanned with respect to said printing medium.

8. A printing apparatus as claimed in claim 1, wherein said printing head is a head for performing printing by ejecting ink.

9. A printing apparatus as claimed in claim 8, wherein said printing head has heating elements for generating thermal energy to make the ink to film-boil, as an energy used for ejecting the ink.

10. A printing registration method for a printing apparatus for performing printing on a printing medium by using a printing head, said method comprising the steps of:

controlling said printing head to form a plurality of patterns, said plurality of patterns being respectively formed corresponding to a plurality of shifting amounts of relative printing positions of a first printing and a second printing to be registered and said plurality of patterns respectively representing optical densities corresponding to said plurality of shifting amounts;

measuring the respective optical densities of said plurality of patterns in a measuring operation by using an optical measuring means;

performing printing registration processing between said first printing and said second printing on the basis of the variation of said optical densities represented by said plurality of patterns measured by said optical measuring means;

performing a detecting operation distinct from the measurement of said optical densities in the measuring operation by using said optical measuring means; and switching controlling characteristics of said optical measuring means between the measuring operation and the detecting operation, respectively, by using a region where a characteristic of said optical measuring means is linear and a region where the characteristic of said optical measuring means is saturated.

11. A printing system provided with a printing apparatus for performing printing on a printing medium by using a printing head, and a host apparatus for supplying image data to said printing apparatus, comprising:

means for controlling said printing head to form a plurality of patterns, said plurality of patterns being respectively formed corresponding to a plurality of shifting amounts of relative printing positions of a first printing and a second printing to be registered and said plurality of patterns respectively representing optical densities corresponding to said plurality of shifting amounts;

optical measuring means for measuring respective optical densities of said plurality of patterns in a measuring operation;

means for performing printing registration processing between said first printing and said second printing on the basis of the variation of said optical densities represented by said plurality of patterns measured by said optical measuring means;

means for performing a detecting operation distinct from the measurement of said optical densities in the measuring operation by using said optical measuring means; and means for switching controlling characteristics of said optical measuring means between the measuring operation and the detecting operation, respectively, by using a region where a characteristic of said optical measuring means is linear and a region where the characteristic of said optical measuring means is saturated.

* * * * *

UNITED STATES PATENT AND TRADEMARK OFFICE

CERTIFICATE OF CORRECTION

PATENT NO. : 6,371,592 B1
DATED : April 16, 2002
INVENTOR(S) : Otsuka et al.

It is certified that error appears in the above-identified patent and that said Letters Patent is hereby corrected as shown below:

Column 2,
Line 62, “sing” should read -- using --.

Column 3,
Line 5, “printing, to” should read -- printing to --.

Signed and Sealed this

Ninth Day of July, 2002

*Attest:*

*Attesting Officer*

JAMES E. ROGAN
*Director of the United States Patent and Trademark Office*